US008092302B2

(12) United States Patent
Cuddy et al.

(10) Patent No.: US 8,092,302 B2
(45) Date of Patent: Jan. 10, 2012

(54) GAMING SYSTEM, GAMING DEVICE AND METHOD PROVIDING TIERED PROGRESSIVE BONUSING SYSTEM

(75) Inventors: Ryan W. Cuddy, Reno, NV (US); Mohammed A. Saffari, Reno, NV (US); Bryan D. Wolf, Reno, NV (US)

(73) Assignee: IGT, Reno, NV (US)

( * ) Notice: Subject to any disclaimer, the term of this patent is extended or adjusted under 35 U.S.C. 154(b) by 664 days.

(21) Appl. No.: 12/269,456

(22) Filed: Nov. 12, 2008

(65) Prior Publication Data

US 2010/0120498 A1 May 13, 2010

(51) Int. Cl.
*A63F 9/00* (2006.01)

(52) U.S. Cl. ..... 463/27; 463/26

(58) Field of Classification Search ..... 463/26–27, 463/40–42

See application file for complete search history.

(56) References Cited

U.S. PATENT DOCUMENTS

| | | | |
|---|---|---|---|
| 5,401,023 | A | 3/1995 | Wood |
| 5,655,961 | A | 8/1997 | Acres et al. |
| 5,702,304 | A | 12/1997 | Acres et al. |
| 5,741,183 | A | 4/1998 | Acres et al. |
| 5,752,882 | A | 5/1998 | Acres et al. |
| 5,766,076 | A | 6/1998 | Pease et al. |
| 5,816,918 | A | 10/1998 | Kelly et al. |
| 5,820,459 | A | 10/1998 | Acres et al. |
| 5,833,540 | A | 11/1998 | Miodunski et al. |
| 5,836,817 | A | 11/1998 | Acres et al. |
| 5,855,515 | A | 1/1999 | Pease et al. |
| 5,885,158 | A | 3/1999 | Torango et al. |
| 6,007,426 | A | 12/1999 | Kelly et al. |
| 6,015,344 | A | 1/2000 | Kelly et al. |
| 6,110,041 | A | 8/2000 | Walker et al. |
| 6,162,122 | A | 12/2000 | Acres et al. |
| 6,241,608 | B1 | 6/2001 | Torango |
| 6,244,958 | B1 | 6/2001 | Acres |
| 6,257,981 | B1 | 7/2001 | Acres et al. |

(Continued)

FOREIGN PATENT DOCUMENTS

EP 1 359 531 11/2003

(Continued)

OTHER PUBLICATIONS

Atronic Systems Progressive Products at G2E, published by Atronic in 2004, printed from ForRelease.com.

(Continued)

*Primary Examiner* — Dmitry Suhol
*Assistant Examiner* — David Duffy
(74) *Attorney, Agent, or Firm* — K&L Gates LLP

(57) ABSTRACT

The gaming system and method disclosed herein provides a plurality of players with an opportunity to win a plurality of progressive awards maintained by the gaming system. The gaming system accumulates a quantity of progressive event points for each player playing at one of the gaming machines in the gaming system. In one embodiment, the gaming system uses an accumulated quantity of progressive event points for a designated player to determine which one or more of the progressive awards the designated player wins. In another embodiment, the gaming system uses an accumulated quantity of progressive event points to determine the designated player's probability of winning one or more of the progressive awards. Accordingly, the gaming system provides a point-based system in which either a progressive award to win or a probability of winning a progressive award is determined based on the quantities of progressive event points accumulated by the players.

23 Claims, 13 Drawing Sheets

U.S. PATENT DOCUMENTS

| | | | | |
|---|---|---|---|---|
| 6,302,793 | B1 | 10/2001 | Fertitta, III et al. | |
| 6,319,125 | B1 | 11/2001 | Acres | |
| 6,364,768 | B1 | 4/2002 | Acres et al. | |
| 6,371,852 | B1 | 4/2002 | Acres | |
| 6,431,983 | B2 | 8/2002 | Acres | |
| 6,435,968 | B1 | 8/2002 | Torango | |
| RE37,885 | E | 10/2002 | Acres et al. | |
| 6,527,638 | B1 | 3/2003 | Walker et al. | |
| 6,592,460 | B2 | 7/2003 | Torango | |
| 6,599,193 | B2 | 7/2003 | Baerlocher et al. | |
| 6,634,942 | B2 | 10/2003 | Walker et al. | |
| 6,672,589 | B1 | 1/2004 | Lemke et al. | |
| 6,712,695 | B2 | 3/2004 | Mothwurf et al. | |
| 6,712,697 | B2 | 3/2004 | Acres | |
| 6,712,698 | B2 | 3/2004 | Paulsen et al. | |
| 6,769,982 | B1 | 8/2004 | Brosnan | |
| 6,776,715 | B2 | 8/2004 | Price | |
| 6,800,030 | B2 | 10/2004 | Acres | |
| 6,811,486 | B1 | 11/2004 | Luciano, Jr. | |
| 6,832,958 | B2 | 12/2004 | Acres et al. | |
| 6,846,238 | B2 | 1/2005 | Wells | |
| 6,857,957 | B2 | 2/2005 | Marks et al. | |
| 6,877,745 | B1 | 4/2005 | Walker et al. | |
| 6,884,167 | B2 | 4/2005 | Walker et al. | |
| 6,887,154 | B1 | 5/2005 | Luciano, Jr. et al. | |
| 6,908,387 | B2 | 6/2005 | Hedrick et al. | |
| 6,910,962 | B2 | 6/2005 | Marks et al. | |
| 6,935,952 | B2 | 8/2005 | Walker et al. | |
| 6,939,234 | B2 | 9/2005 | Beatty | |
| RE38,812 | E | 10/2005 | Acres et al. | |
| 6,991,544 | B2 | 1/2006 | Soltys et al. | |
| 6,997,803 | B2 | 2/2006 | Lemay et al. | |
| 7,018,291 | B1 | 3/2006 | Lemke et al. | |
| 7,056,215 | B1 | 6/2006 | Olive | |
| 7,063,617 | B2 | 6/2006 | Brosnan et al. | |
| 7,077,746 | B2 | 7/2006 | Torango | |
| 7,108,603 | B2 | 9/2006 | Olive | |
| 7,112,138 | B2 | 9/2006 | Hedrick et al. | |
| 7,115,033 | B1 | 10/2006 | Timperley | |
| 7,198,571 | B2 | 4/2007 | Lemay et al. | |
| 7,235,011 | B2 | 6/2007 | Randall et al. | |
| 7,255,645 | B2 | 8/2007 | Steil et al. | |
| 7,291,068 | B2 | 11/2007 | Bryant et al. | |
| 7,303,470 | B2 | 12/2007 | George et al. | |
| 7,311,605 | B2 | 12/2007 | Moser | |
| 7,318,774 | B2 | 1/2008 | Bryant et al. | |
| 7,318,775 | B2 | 1/2008 | Brosnan et al. | |
| 7,326,115 | B2 | 2/2008 | Baerlocher | |
| 7,328,838 | B2 | 2/2008 | Brosnan et al. | |
| 7,357,713 | B2 | 4/2008 | Marks et al. | |
| 7,357,716 | B2 | 4/2008 | Marks et al. | |
| 7,371,171 | B1 | 5/2008 | Englman et al. | |
| 7,384,336 | B2 | 6/2008 | Torango | |
| 7,384,337 | B2 | 6/2008 | Thomas | |
| 7,402,101 | B2 | 7/2008 | Casey | |
| 7,404,765 | B2 | 7/2008 | Soltys et al. | |
| 7,419,430 | B1 | 9/2008 | Joshi et al. | |
| 7,427,233 | B2 | 9/2008 | Walker et al. | |
| 7,427,234 | B2 | 9/2008 | Soltys et al. | |
| 7,455,587 | B2 | 11/2008 | Olive et al. | |
| 7,470,184 | B2 | 12/2008 | Baerlocher et al. | |
| 7,682,245 | B2 * | 3/2010 | Nguyen | 463/25 |
| 7,976,389 | B2 * | 7/2011 | Cannon et al. | 463/42 |
| 2001/0036855 | A1 | 11/2001 | DeFrees-parrott et al. | |
| 2001/0036864 | A1 | 11/2001 | Melas | |
| 2002/0119824 | A1 * | 8/2002 | Allen | 463/42 |
| 2002/0142825 | A1 | 10/2002 | Lark et al. | |
| 2002/0142846 | A1 | 10/2002 | Paulsen | |
| 2002/0147049 | A1 | 10/2002 | Carter, Sr. | |
| 2002/0198044 | A1 | 12/2002 | Walker et al. | |
| 2003/0032474 | A1 | 2/2003 | Kaminkow | |
| 2003/0036425 | A1 | 2/2003 | Kaminkow et al. | |
| 2003/0078101 | A1 | 4/2003 | Schneider et al. | |
| 2003/0119579 | A1 | 6/2003 | Walker et al. | |
| 2003/0166410 | A1 | 9/2003 | Olive | |
| 2003/0181237 | A1 | 9/2003 | Olive | |
| 2003/0190958 | A1 | 10/2003 | Paulsen | |
| 2003/0216170 | A1 | 11/2003 | Walker et al. | |
| 2003/0222402 | A1 | 12/2003 | Olive | |
| 2004/0036212 | A1 | 2/2004 | Walker et al. | |
| 2004/0082373 | A1 | 4/2004 | Cole et al. | |
| 2004/0087370 | A1 | 5/2004 | Tarantino | |
| 2004/0092303 | A1 | 5/2004 | George et al. | |
| 2004/0092304 | A1 | 5/2004 | George et al. | |
| 2004/0106448 | A1 | 6/2004 | Gauselmann | |
| 2004/0113360 | A1 | 6/2004 | George et al. | |
| 2004/0192434 | A1 | 9/2004 | Walker et al. | |
| 2004/0198487 | A1 | 10/2004 | Schneider | |
| 2004/0204214 | A1 | 10/2004 | Tucci | |
| 2004/0229683 | A1 | 11/2004 | Mothwurf et al. | |
| 2004/0229700 | A1 * | 11/2004 | Cannon et al. | 463/42 |
| 2004/0248634 | A1 | 12/2004 | Herrmann et al. | |
| 2005/0003890 | A1 | 1/2005 | Hedrick et al. | |
| 2005/0014554 | A1 | 1/2005 | Walker et al. | |
| 2005/0014558 | A1 | 1/2005 | Estey | |
| 2005/0026676 | A1 | 2/2005 | Olive | |
| 2005/0027381 | A1 | 2/2005 | George et al. | |
| 2005/0037832 | A1 | 2/2005 | Cannon | |
| 2005/0037837 | A1 | 2/2005 | Rowe | |
| 2005/0049043 | A1 | 3/2005 | Crivelli et al. | |
| 2005/0054417 | A1 | 3/2005 | Parrott et al. | |
| 2005/0054429 | A1 | 3/2005 | Baerlocher et al. | |
| 2005/0054439 | A1 | 3/2005 | Rowe et al. | |
| 2005/0059467 | A1 | 3/2005 | Saffari et al. | |
| 2005/0070356 | A1 | 3/2005 | Mothwurf et al. | |
| 2005/0075165 | A1 | 4/2005 | George et al. | |
| 2005/0096121 | A1 | 5/2005 | Gilliland et al. | |
| 2005/0101374 | A1 | 5/2005 | Acres | |
| 2005/0101383 | A1 | 5/2005 | Wells | |
| 2005/0119047 | A1 | 6/2005 | Olive | |
| 2005/0127606 | A1 | 6/2005 | Snow et al. | |
| 2005/0143168 | A1 | 6/2005 | Torango | |
| 2005/0153768 | A1 | 7/2005 | Paulsen | |
| 2005/0153773 | A1 | 7/2005 | Nguyen et al. | |
| 2005/0176499 | A1 | 8/2005 | Stronach | |
| 2005/0181875 | A1 | 8/2005 | Hoehne et al. | |
| 2005/0187014 | A1 | 8/2005 | Saffari et al. | |
| 2005/0187022 | A1 | 8/2005 | Walker et al. | |
| 2005/0209004 | A1 | 9/2005 | Torango | |
| 2005/0227756 | A1 | 10/2005 | Kane et al. | |
| 2005/0239542 | A1 | 10/2005 | Olsen | |
| 2005/0239546 | A1 | 10/2005 | Hedrick et al. | |
| 2005/0255911 | A1 | 11/2005 | Nguyen et al. | |
| 2005/0255922 | A1 | 11/2005 | Nguyen et al. | |
| 2005/0261055 | A1 | 11/2005 | Casey et al. | |
| 2005/0261059 | A1 | 11/2005 | Nguyen et al. | |
| 2005/0261060 | A1 | 11/2005 | Nguyen et al. | |
| 2005/0261061 | A1 | 11/2005 | Nguyen et al. | |
| 2005/0282609 | A1 | 12/2005 | Olive | |
| 2006/0003829 | A1 | 1/2006 | Thomas | |
| 2006/0003835 | A1 | 1/2006 | Olive | |
| 2006/0014579 | A1 | 1/2006 | Kane et al. | |
| 2006/0019750 | A1 | 1/2006 | Beatty | |
| 2006/0025197 | A1 | 2/2006 | Kane et al. | |
| 2006/0035696 | A1 | 2/2006 | Walker et al. | |
| 2006/0035706 | A1 | 2/2006 | Thomas et al. | |
| 2006/0040723 | A1 | 2/2006 | Baerlocher et al. | |
| 2006/0040725 | A1 | 2/2006 | Walker et al. | |
| 2006/0040732 | A1 | 2/2006 | Baerlocher et al. | |
| 2006/0040733 | A1 | 2/2006 | Baerlocher et al. | |
| 2006/0040734 | A1 | 2/2006 | Baerlocher et al. | |
| 2006/0052160 | A1 | 3/2006 | Saffari et al. | |
| 2006/0052161 | A1 | 3/2006 | Soukup et al. | |
| 2006/0052162 | A1 | 3/2006 | Soukup et al. | |
| 2006/0058089 | A1 | 3/2006 | White et al. | |
| 2006/0068872 | A1 | 3/2006 | Walker et al. | |
| 2006/0068873 | A1 | 3/2006 | Gomez | |
| 2006/0068876 | A1 | 3/2006 | Kane et al. | |
| 2006/0068913 | A1 | 3/2006 | Walker et al. | |
| 2006/0073869 | A1 | 4/2006 | Lemay et al. | |
| 2006/0073870 | A1 | 4/2006 | Cannon | |
| 2006/0073887 | A1 | 4/2006 | Nguyen et al. | |
| 2006/0073888 | A1 | 4/2006 | Nguyen et al. | |
| 2006/0073897 | A1 | 4/2006 | Englman et al. | |
| 2006/0079309 | A1 | 4/2006 | Walker et al. | |
| 2006/0079317 | A1 | 4/2006 | Flemming et al. | |
| 2006/0079318 | A1 | 4/2006 | Aoki et al. | |

2006/0082056 A1 4/2006 Kane et al.
2006/0100009 A1 5/2006 Walker et al.
2006/0100019 A1 5/2006 Hornik et al.
2006/0111164 A1 5/2006 Hornik et al.
2006/0111169 A1 5/2006 Hornik et al.
2006/0111172 A1 5/2006 Walker et al.
2006/0111175 A1 5/2006 Walker et al.
2006/0121969 A1 6/2006 Marks et al.
2006/0121972 A1 6/2006 Walker et al.
2006/0121978 A1 6/2006 Hornik et al.
2006/0128460 A1 6/2006 Muir et al.
2006/0142079 A1 6/2006 Ikehara et al.
2006/0142086 A1 6/2006 Blackburn et al.
2006/0148549 A1 7/2006 Walker et al.
2006/0148558 A1 7/2006 Olive
2006/0160605 A1 7/2006 Hornik et al.
2006/0160614 A1 7/2006 Walker et al.
2006/0160625 A1 7/2006 Englman et al.
2006/0166730 A1 7/2006 Olive
2006/0166735 A1 7/2006 Steil et al.
2006/0172803 A1 8/2006 Hardy et al.
2006/0172804 A1 8/2006 Acres et al.
2006/0178196 A1 8/2006 Thomas
2006/0178199 A1 8/2006 Thomas
2006/0178202 A1 8/2006 Hughes et al.
2006/0178203 A1 8/2006 Hughes et al.
2006/0183529 A1 8/2006 Acres et al.
2006/0189371 A1 8/2006 Walker et al.
2006/0189376 A1 8/2006 Hornik et al.
2006/0189377 A1 8/2006 Gomez et al.
2006/0189379 A1 8/2006 Pacey
2006/0194633 A1 8/2006 Paulsen
2006/0205468 A1 9/2006 Saffari et al.
2006/0205482 A1 9/2006 Crivelli
2006/0211466 A1 9/2006 Ward et al.
2006/0211472 A1 9/2006 Walker et al.
2006/0211473 A1 9/2006 Walker et al.
2006/0211474 A1 9/2006 Walker et al.
2006/0211478 A1 9/2006 Walker et al.
2006/0211484 A1 9/2006 Hornik et al.
2006/0217187 A1 9/2006 Walker et al.
2006/0217188 A1 9/2006 Walker et al.
2006/0217189 A1 9/2006 Walker et al.
2006/0223606 A1 10/2006 Walker et al.
2006/0223607 A1 10/2006 Walker et al.
2006/0223608 A1 10/2006 Walker et al.
2006/0223614 A1 10/2006 Olive
2006/0223615 A1 10/2006 Englman
2006/0229121 A1 10/2006 Rasmussen et al.
2006/0240890 A1 10/2006 Walker et al.
2006/0247026 A1 11/2006 Walker et al.
2006/0247029 A1 11/2006 Walker et al.
2006/0252482 A1 11/2006 Walker et al.
2006/0252529 A1 11/2006 Hedrick et al.
2006/0270477 A1 11/2006 Snow
2006/0277100 A1 12/2006 Parham
2006/0279044 A1 12/2006 Pacey
2006/0281528 A1 12/2006 Hall et al.
2006/0281541 A1 12/2006 Nguyen et al.
2006/0284378 A1 12/2006 Snow et al.
2006/0287034 A1 12/2006 Englman et al.
2006/0287035 A1 12/2006 Walker et al.
2006/0287054 A1 12/2006 Walker et al.
2006/0287091 A1 12/2006 Walker et al.
2006/0287092 A1 12/2006 Walker et al.
2006/0287093 A1 12/2006 Walker et al.
2006/0287095 A1 12/2006 Mattice et al.
2007/0026924 A1 2/2007 Taylor
2007/0026941 A1 2/2007 Block et al.
2007/0032301 A1 2/2007 Acres et al.
2007/0045958 A1 3/2007 Rader et al.
2007/0054723 A1 3/2007 Mattice et al.
2007/0054726 A1 3/2007 Muir et al.
2007/0054729 A1 3/2007 Hornik et al.
2007/0054732 A1 3/2007 Baerlocher
2007/0054733 A1 3/2007 Baerlocher
2007/0060237 A1 3/2007 Rowe et al.
2007/0060271 A1 3/2007 Cregan et al.
2007/0060314 A1 3/2007 Baerlocher et al.
2007/0060319 A1 3/2007 Block et al.
2007/0060320 A1 3/2007 Kelly et al.
2007/0060321 A1 3/2007 Vasquez et al.
2007/0060326 A1 3/2007 Juds et al.
2007/0060365 A1 3/2007 Tien et al.
2007/0077978 A1 4/2007 Walker et al.
2007/0077981 A1 4/2007 Hungate et al.
2007/0077985 A1 4/2007 Walker et al.
2007/0077990 A1 4/2007 Cuddy et al.
2007/0087832 A1 4/2007 Abbott et al.
2007/0105619 A1 5/2007 Kniesteadt et al.
2007/0105620 A1 5/2007 Cuddy et al.
2007/0106553 A1 5/2007 Jordan et al.
2007/0111778 A1 5/2007 Walker et al.
2007/0111785 A1 5/2007 Olive
2007/0117607 A1 5/2007 Olive
2007/0117608 A1 5/2007 Roper et al.
2007/0117616 A1 5/2007 Bartholomew
2007/0135214 A1 6/2007 Walker et al.
2007/0135215 A1 6/2007 Walker et al.
2007/0136817 A1 6/2007 Nguyen
2007/0155485 A1 7/2007 Cuddy et al.
2007/0155490 A1 7/2007 Phillips et al.
2007/0155512 A1 7/2007 Wells et al.
2007/0167210 A1 7/2007 Kelly et al.
2007/0167226 A1 7/2007 Kelly et al.
2007/0167229 A1 7/2007 Lemay et al.
2007/0173311 A1 7/2007 Morrow et al.
2007/0178970 A1 8/2007 Lemay et al.
2007/0184887 A1 8/2007 Cannon
2007/0184891 A1 8/2007 Thomas
2007/0191087 A1 8/2007 Thomas et al.
2007/0191088 A1 8/2007 Breckner et al.
2007/0191107 A1 8/2007 Walker et al.
2007/0202941 A1 8/2007 Miltenberger et al.
2007/0213114 A1 9/2007 Caspers et al.
2007/0218975 A1 9/2007 Iddings et al.
2007/0218982 A1 9/2007 Baerlocher
2007/0218983 A1 9/2007 Lombardo
2007/0243925 A1 10/2007 Lemay et al.
2007/0243928 A1 10/2007 Iddings
2007/0243934 A1 10/2007 Little et al.
2007/0254733 A1 11/2007 Hornik et al.
2007/0254734 A1 11/2007 Gilmore et al.
2007/0257429 A1 11/2007 Kane et al.
2007/0259709 A1 11/2007 Kelly et al.
2007/0259711 A1 11/2007 Thomas
2007/0270208 A1 11/2007 Caspers et al.
2007/0270213 A1 11/2007 Nguyen et al.
2007/0293293 A1 12/2007 Baerlocher et al.
2007/0298857 A1 12/2007 Schlottmann et al.
2007/0298873 A1 12/2007 Nguyen et al.
2007/0298874 A1 12/2007 Baerlocher et al.
2007/0298875 A1 12/2007 Baerlocher et al.
2008/0004104 A1 1/2008 Durham et al.
2008/0004106 A1 1/2008 Bryant et al.
2008/0009333 A1 1/2008 Walker et al.
2008/0009334 A1 1/2008 Walker et al.
2008/0009335 A1 1/2008 Walker et al.
2008/0009344 A1 1/2008 Graham et al.
2008/0015012 A1 1/2008 Englman et al.
2008/0020822 A1 1/2008 Cuddy et al.
2008/0020824 A1 1/2008 Cuddy et al.
2008/0020825 A1 1/2008 Cuddy et al.
2008/0020829 A1 1/2008 Baerlocher
2008/0020831 A1 1/2008 Ikehara et al.
2008/0020832 A1 1/2008 Iddings et al.
2008/0020833 A1 1/2008 Baerlocher et al.
2008/0020834 A1 1/2008 Breckner et al.
2008/0020846 A1 1/2008 Vasquez et al.
2008/0020847 A1 1/2008 Kniesteadt et al.
2008/0020848 A1 1/2008 Muir et al.
2008/0026827 A1 1/2008 Skotarczak et al.
2008/0026844 A1 1/2008 Wells
2008/0032764 A1 2/2008 Cannon
2008/0032787 A1 2/2008 Low et al.
2008/0039191 A1 2/2008 Cuddy
2008/0039196 A1* 2/2008 Walther et al. ..... 463/27
2008/0045341 A1 2/2008 Englman 2008/0045344 A1 2/2008 Schlottmann et al.
2008/0051193 A1 2/2008 Kaminkow et al.
2008/0058098 A1 3/2008 Seelig et al.
2008/0064478 A1 3/2008 Roukis et al.
2008/0064480 A1 3/2008 Randall
2008/0064496 A1 3/2008 Olive
2008/0064502 A1 3/2008 Schlottmann et al.
2008/0070652 A1 3/2008 Nguyen et al.
2008/0070676 A1 3/2008 Baerlocher et al.
2008/0070677 A1 3/2008 Baerlocher et al.
2008/0070678 A1 3/2008 Baerlocher et al.
2008/0070680 A1 3/2008 Baerlocher et al.
2008/0070693 A1 3/2008 Schlottmann et al.
2008/0070695 A1 3/2008 Baerlocher et al.
2008/0076496 A1 3/2008 Baerlocher et al.
2008/0076503 A1 3/2008 Mattice et al.
2008/0076514 A1 3/2008 Baerlocher et al.
2008/0076515 A1 3/2008 Baerlocher et al.
2008/0076517 A1 3/2008 Baerlocher et al.
2008/0076520 A1 3/2008 Chan et al.
2008/0076527 A1 3/2008 Low et al.
2008/0076531 A1 3/2008 Baerlocher et al.
2008/0076532 A1 3/2008 Graham et al.
2008/0076534 A1 3/2008 Iddings et al.
2008/0076540 A1 3/2008 Aida
2008/0076542 A1 3/2008 Iddings et al.
2008/0076548 A1 3/2008 Paulsen
2008/0076552 A1 3/2008 Baerlocher et al.
2008/0076571 A1 3/2008 Frerking
2008/0076576 A1 3/2008 Graham et al.
2008/0081689 A1* 4/2008 Seelig et al. ..... 463/23
2008/0081690 A1 4/2008 Baerlocher et al.
2008/0081691 A1 4/2008 Baerlocher et al.
2008/0085771 A1 4/2008 Iddings et al.
2008/0085772 A1 4/2008 Iddings et al.
2008/0090648 A1 4/2008 Brosnan et al.
2008/0090650 A1 4/2008 Tarantino
2008/0090651 A1 4/2008 Baerlocher
2008/0090655 A1 4/2008 Marks et al.
2008/0096645 A1 4/2008 Frerking et al.
2008/0102931 A1 5/2008 Marks et al.
2008/0102935 A1 5/2008 Finnimore
2008/0108406 A1 5/2008 Oberberger
2008/0108409 A1 5/2008 Cole et al.
2008/0108410 A1 5/2008 Baerlocher
2008/0108423 A1 5/2008 Benbrahim et al.
2008/0108425 A1 5/2008 Oberberger
2008/0108426 A1 5/2008 Nguyen et al.
2008/0108430 A1 5/2008 Evans
2008/0108431 A1 5/2008 Cuddy et al.
2008/0113714 A1 5/2008 Vallejo
2008/0113771 A1 5/2008 Baerlocher et al.
2008/0113779 A1 5/2008 Cregan
2008/0113780 A1 5/2008 Vallejo
2008/0113814 A1 5/2008 Osburn
2008/0119283 A1 5/2008 Baerlocher
2008/0120221 A1 5/2008 Toneguzzo
2008/0132320 A1 6/2008 Rodgers
2008/0132329 A1 6/2008 Jorasch et al.
2008/0139274 A1 6/2008 Baerlocher
2008/0139283 A1 6/2008 Kelly et al.
2008/0139290 A1 6/2008 Kniesteadt et al.
2008/0139305 A1 6/2008 Vallejo et al.
2008/0146325 A1 6/2008 Walker et al.
2008/0146344 A1 6/2008 Rowe et al.
2008/0149705 A1 6/2008 Giobbit et al.
2008/0153563 A1 6/2008 Englman
2008/0153564 A1 6/2008 Baerlocher et al.
2008/0167130 A1 7/2008 Kroeckel et al.
2008/0176624 A1 7/2008 Phillips et al.
2008/0176645 A1 7/2008 Griswold et al.
2008/0176650 A1 7/2008 Wolf et al.
2008/0176660 A1 7/2008 Kelly et al.
2008/0182650 A1 7/2008 Randall et al.
2008/0182655 A1 7/2008 Dewaal et al.
2008/0200241 A1 8/2008 Davies
2008/0200244 A1 8/2008 Rowe et al.
2008/0207298 A1 8/2008 Marks et al.
2008/0214288 A1 9/2008 Toneguzzo
2008/0214293 A1 9/2008 Kelly et al.
2008/0214300 A1 9/2008 Williams et al.
2008/0220852 A1 9/2008 Olive
2008/0220857 A1 9/2008 Kelly et al.
2008/0227523 A1 9/2008 Vallejo et al.
2008/0227524 A1 9/2008 Kelly et al.
2008/0227530 A1 9/2008 Lemay et al.
2008/0227538 A1 9/2008 Kelly et al.
2008/0227551 A1 9/2008 Kelly et al.
2008/0234047 A1 9/2008 Nguyen
2008/0242399 A1 10/2008 Toneguzzo
2008/0248862 A1 10/2008 Joshi et al.
2008/0248867 A1 10/2008 Englman et al.
2008/0254883 A1 10/2008 Patel et al.
2008/0254885 A1 10/2008 Kelly
2008/0254886 A1 10/2008 Kelly
2008/0254893 A1 10/2008 Patel et al.
2008/0261682 A1 10/2008 Phillips et al.
2008/0268937 A1 10/2008 Bryant et al.
2008/0268945 A1 10/2008 Bryant et al.
2008/0268946 A1 10/2008 Roemer
2008/0274783 A1 11/2008 Walker et al.
2008/0274790 A1 11/2008 Cannon
2008/0274796 A1 11/2008 Lube
2008/0274800 A1 11/2008 Bryant et al.
2008/0274801 A1 11/2008 Bryant et al.
2008/0287184 A1 11/2008 Boesen
2008/0300049 A1 12/2008 Anderson et al.
2008/0305864 A1 12/2008 Kelly et al.
2008/0305865 A1 12/2008 Kelly et al.
2008/0305866 A1* 12/2008 Kelly et al. ..... 463/27
2008/0311979 A1 12/2008 Walker et al.
2008/0318655 A1 12/2008 Davies
2009/0005152 A9 1/2009 Kelly et al.
2009/0005158 A9 1/2009 Kelly et al.
2009/0005165 A1 1/2009 Arezina et al.
2009/0005170 A9 1/2009 Kelly et al.
2009/0011827 A1 1/2009 Englman et al.
2009/0029765 A1 1/2009 Acres
2009/0042645 A1* 2/2009 Graham et al. ..... 463/27
2009/0048012 A1* 2/2009 Patel et al. ..... 463/20
2009/0111561 A1* 4/2009 Dewaal et al. ..... 463/20
2010/0120503 A1* 5/2010 Hoffman et al. ..... 463/20

FOREIGN PATENT DOCUMENTS

WO WO 2006 002462 1/2006
WO WO 2006 014990 2/2006
WO WO 2006 039349 4/2006
WO WO 2006 130597 12/2006
WO WO 2006 130611 12/2006
WO WO 2007 028108 3/2007
WO WO 2007 030733 3/2007
WO WO 2007 085054 8/2007
WO WO 2007 109675 9/2007
WO WO 2007 117502 10/2007
WO WO 2007 123858 11/2007
WO WO 2007 124047 11/2007
WO WO 2007 127258 11/2007
WO WO 2007 127259 11/2007
WO WO 2007 130464 11/2007
WO WO 2007 139774 12/2007
WO WO 2007 149238 12/2007
WO WO 2008 021449 2/2008
WO WO 2008 024349 2/2008
WO WO 2008 030955 3/2008
WO WO 2008 033877 3/2008
WO WO 2008 039403 4/2008
WO WO 2008 039848 4/2008
WO WO 2008 045398 4/2008
WO WO 2008 048634 4/2008
WO WO 2008 051796 5/2008
WO WO 2008 054723 5/2008
WO WO 2008 060426 5/2008
WO WO 2008 060442 5/2008
WO WO 2008 060978 5/2008
WO WO 2008 063297 5/2008
WO WO 2008 063394 5/2008
WO WO 2008 063395 5/2008
WO WO 2008 103246 8/2008

| | | |
|---|---|---|
| WO | WO 2008 103578 | 8/2008 |
| WO | WO 2008 106404 | 9/2008 |
| WO | WO 2008 133849 | 11/2008 |

OTHER PUBLICATIONS

Bally Live-Server Based Gaming brochure, written by Bally Gaming Systems, published in 2006.
Cash Express Advertisements, written by Aristocrat, published in 2002.
Fast Buck Systems Manual, written by International Game Technology, available to Mirage shift supervisors at least as early as May 30, 1990.
Hot Shot Progressive Article, written by Strictly Slots, published in Feb. 2006.
Jackpot Carnival Hyperlink Advertisement, written by Aristocrat, published prior to 2002.
Jackpot Party Brochure and Articles written by WMS Gaming, Inc, published in 1998.
PEM—Precision Electronic Meter, written by GRIPS Electronic GmbH, printed from website reported as archived on Feb. 20, 1997 (available at http://web.archive.org/web/19970220165753/www.grips.com/pem.htm).
Player Tracking on Slots, written by GRIPS Electronic GmbH, printed from website reported as archived on Feb. 20, 1997 (available at http://web.archive/org/web/19970220165921/www.grips.com/playtrac.htm).
ProLINK Progressive Controller User/Reference Manual, written by Casino Data Systems, published in Apr. 1997.
Star Wars Article, written by Indian Gaming, published in Nov. 2007.
Wide Area Progressive Link System, written by GRIPS Electronic GmbH, printed from website reported as archived on Feb. 20, 1997 (available at http://web.archive.org/web/19970220165457/www.grips.com/wap.htm).
Zorro Advertisement, written by Aristocrat, published in 2004.

* cited by examiner

FIG. 5A

150

| PLAYER | WAGER FOR PREVIOUS GAME | PROBABILITY TO WIN A PROGRESSIVE AWARD |
|---|---|---|
| A | $1 | 0.025 |
| B | $2 | 0.050 |
| C | $3 | 0.075 |

FIG. 5B

160

| PROBABILITIES OF WINNING DIFFERENT PROGRESSIVE AWARDS BASED ON ACCUMULATED POINTS | | | | | |
|---|---|---|---|---|---|
| POINTS FOR SELECTED PLAYER | PROGRESSIVE AWARD A | PROGRESSIVE AWARD B | PROGRESSIVE AWARDS A AND B | PROGRESSIVE AWARD C | PROGRESSIVE AWARD D |
| 0-49 | 0.0005 | 0.0001 | 0 | 0.002 | 0.99785 |
| 50-199 | 0.0025 | 0.005 | 0 | 0.1 | 0.8925 |
| 200-399 | 0.01 | 0.02 | 0 | 0.4 | 0.57 |
| AT LEAST 400 | 0.02 | 0.04 | 0.01 | 0.8 | 0.13 |

FIG. 6

170

| PROBABILITIES OF WINNING DIFFERENT PROGRESSIVE AWARDS BASED ON ACCUMULATED POINTS | | | | | |
|---|---|---|---|---|---|
| POINTS FOR SELECTED PLAYER | PROGRESSIVE AWARD A | PROGRESSIVE AWARD B | PROGRESSIVE AWARDS A AND B | PROGRESSIVE AWARD C | PROGRESSIVE AWARD D |
| 0-49 | 0% | 0% | 0% | 0% | 100% |
| 50-199 | 0% | 0% | 0% | 11% | 89% |
| 200-399 | 0% | 3% | 0% | 40% | 57% |
| AT LEAST 400 | 1% | 1% | 5% | 80% | 13% |

FIG. 8

230

| PRIMARY PROGRESSIVE AWARD | | |
|---|---|---|
| PLAYER | WAGER FOR PREVIOUS GAME | PROBABILITY TO WIN THE PRIMARY PROGRESSIVE AWARD WHEN TRIGGERED |
| A | $1 | 0.025 |
| B | $2 | 0.050 |
| C | $3 | 0.075 |
| D | $4 | 0.100 |

FIG. 9

240

| SECONDARY PROGRESSIVE AWARDS | | |
|---|---|---|
| POINTS | PROGRESSIVE AWARD LEVEL | CURRENT VALUE |
| 0-99 | LEVEL 1 PROGRESSIVE AWARD | $52.58 |
| 100-299 | LEVEL 2 PROGRESSIVE AWARD | $1,926.84 |
| 300-599 | LEVEL 3 PROGRESSIVE AWARD | $5,621.73 |
| AT LEAST 600 | LEVEL 4 PROGRESSIVE AWARD | $16,442.75 |

FIG. 10A

250

| LEVEL 3 SECONDARY PROGRESSIVE AWARD | | |
|---|---|---|
| WAGER AMOUNT FOR PREVIOUS GAME | NUMBERS OF PLAYERS QUALIFIED FOR LEVEL 3 PROGRESSIVE AWARD AT WAGER AMOUNT | PROBABILITY TO WIN THE LEVEL 3 PROGRESSIVE AWARD FOR EACH QUALIFIED PLAYER AT WAGER AMOUNT |
| $1 | 30 | 0.02 |
| $2 | 60 | 0.04 |
| $3 | 90 | 0.06 |

FIG. 10B

260

| LEVEL 1 SECONDARY PROGRESSIVE AWARD | | |
|---|---|---|
| PLAYERS WHO QUALIFIED FOR LEVEL 1 PROGRESSIVE AWARD | WAGER AMOUNT FOR PREVIOUS GAME | PROBABILITY TO WIN THE LEVEL 1 PROGRESSIVE AWARD |
| A | $0.50 | 0.02 |
| B | $1 | 0.04 |
| C | $2 | 0.08 |

FIG. 11A

270

| TOTAL COIN-IN | MULTI-LEVEL PROGRESSIVE AWARD | CURRENT VALUE |
|---|---|---|
| $0-$100 | LEVEL 1 PROGRESSIVE AWARD | $52.58 |
| $101-$499 | LEVEL 2 PROGRESSIVE AWARD | $1,926.84 |
| $500-$999 | LEVEL 3 PROGRESSIVE AWARD | $5,621.73 |
| AT LEAST $1000 | LEVEL 4 PROGRESSIVE AWARD | $16,442.75 |

FIG. 11B

280

| LEVEL 3 SECONDARY PROGRESSIVE AWARD | | |
|---|---|---|
| ACCUMULATED POINTS | NUMBERS OF PLAYERS WHO QUALIFIED FOR THE LEVEL 3 PROGRESSIVE AWARD WITH THE ACCUMULATED POINTS | PROBABILITY TO WIN THE LEVEL 3 PROGRESSIVE AWARD FOR EACH QUALIFIED PLAYER WITH THE ACCUMULATED POINTS |
| 0-99 | 50 | 0.001 |
| 100-299 | 90 | 0.003 |
| AT LEAST 300 | 125 | 0.005 |

GAMING SYSTEM, GAMING DEVICE AND METHOD PROVIDING TIERED PROGRESSIVE BONUSING SYSTEM

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and based on the amount of the wager (e.g., the higher the wager, the higher the award). Symbols or symbol combinations which are less likely to occur usually provide higher awards.

In such known gaming machines, the amount of the wager made on the base game by the player may vary. For instance, the gaming machine may enable the player to wager a minimum number of credits, such as one credit (e.g., one cent, nickel, dime, quarter or dollar) up to a maximum number of credits, such as five credits. This wager may be made by the player a single time or multiple times in a single play of a primary game. For instance, a slot game may have one or more paylines and the slot game may enable the player to make a wager on each payline in a single play of the primary game. Slot games with one, three, five, nine, fifteen, and twenty-five lines are widely commercially available. Thus, it is known that a gaming machine, such as a slot game, may allow players to make wagers of substantially different amounts on each play of the primary or base game ranging, for example, from one credit up to one-hundred twenty-five credits (e.g., five credits on each of twenty-five separate paylines).

Secondary or bonus games are also known in gaming machines. The secondary or bonus games usually provide an additional award to the player. Secondary or bonus games usually do not require an additional wager by the player to be activated. Secondary or bonus games are generally activated or triggered upon an occurrence of a designated triggering symbol or triggering symbol combination in the primary or base game. For instance, a bonus symbol occurring on the payline on the third reel of a three reel slot machine may trigger the secondary bonus game. When a secondary or bonus game is triggered, the gaming machines generally indicates this to the player through one or more visual and/or audio output devices, such as the reels, lights, speakers, video screens, etc. Part of the enjoyment and excitement of playing certain gaming machines is the occurrence of the secondary or bonus game (even before the player knows how much the bonus award will be).

Progressive awards are also known. In one form, a progressive award includes an initial amount funded by a casino and an additional amount funded through a portion of each wager made on the progressive gaming machine. For example, 1% of each wager placed on the primary game of the gaming machine may be allocated to the progressive award or progressive award fund. The progressive award grows in value as more players play the gaming machine and more portions of the players' wagers are allocated to the progressive award. When a player obtains a winning symbol or symbol combination which results in the progressive award, the accumulated progressive award is provided to the player. After the progressive award is provided to the player, the amount of the next progressive award is reset to the initial value and a portion of each subsequent wager is allocated to that next progressive award.

While such progressive awards are popular amongst players, a number of problems exist with these known progressive award gaming systems. For example, when a progressive award is provided at another gaming machine in a bank of gaming machines which share the progressive awards, a player may feel deflated and not wish to continue playing for a base or reset level progressive award. Such feelings can lead to certain players walking away with jackpot fatigue. That is, jackpot fatigue can occur when a player no longer finds an award desirable or worth the cost of continuing to play. This desire to quit playing is also due to the fact that a player may feel they must wait a substantial period of time for the progressive award to climb back to a high value.

There is a continuing need to provide new and different gaming machines and gaming systems as well as new and different ways to provide awards to players including bonus awards and progressive awards. There is also a continuing need to provide new and different linked or related gaming machines.

SUMMARY

Various embodiments of the gaming system and method disclosed herein provide a plurality of players with an opportunity to win a plurality of progressive awards maintained by the gaming system. In one embodiment, the gaming system accumulates a quantity of progressive event points for each player playing at one of the gaming machines in the gaming system. In one such embodiment, the gaming system uses an accumulated quantity of progressive event points for a designated player to determine which one or more of the progressive awards the designated player will win. In another such embodiment, the gaming system uses an accumulated quantity of progressive event points to determine the designated player's probability of winning one or more of the progressive awards. Accordingly, the gaming system provides a point-based system in which either a progressive award to win or a probability of winning a progressive award is determined based on the quantities of progressive event points accumulated by the players.

In one embodiment, the gaming system causes a plurality of gaming devices to each enable a plurality of players to play one or more games. Each play of one of the games is initiated upon a wager placed by one of the players playing at one of the gaming devices. For each player, the gaming system accumulates a quantity of points. In one embodiment, the gaming system accumulates the quantity of progressive event points for each player in association with that player's individual plays of the game. In one such embodiment, the gaming system accumulates the quantity of progressive event points for each player based on a number of designated symbols generated in that player's individual plays of the game.

In one embodiment, the gaming system selects one of a plurality of players based on a designated wager amount placed by each player and determines which one, if any, of the maintained progressive awards to provide the selected player based on a quantity of progressive event points accumulated by the selected player. In this embodiment, after an occurrence of a triggering event, the gaming system selects one of the players to win one of a plurality of maintained progressive awards. The selection of which player is based on each player's designated wager relative to other players' designated wagers. After the gaming system selects one of the players, the gaming system assigns the selected player to one of a plurality of progressive event groups or progressive event tiers based on the quantity of progressive event points accumulated by the selected player. After assigning the selected player to one of the progressive event tiers, the gaming system determines which one of the progressive awards to provide to the selected player in accordance with a probability of being provided for each one of the maintained progressive awards. The probabilities for the maintained progressive awards are associated with the tier or group assigned to the selected player. In this embodiment, the gaming system randomly selects one of the maintained progressive awards in accordance with such probabilities. The gaming system provides the selected player the randomly selected progressive award. That is, the selected player's accumulated quantity of progressive event points determines that player's probability to win at least one of the maintained progressive awards.

In another embodiment, the gaming system utilizes the relative points accumulated by each of the players to determine whether that player will be provided one of a primary progressive award and/or a plurality of secondary progressive awards maintained by the gaming system. In one such embodiment, the primary progressive award is associated with a primary triggering event and each one of the secondary progressive awards is associated with a different secondary triggering event. In this embodiment, at least one of the secondary progressive awards is also associated with the primary triggering event. The gaming system determines whether the primary triggering event occurs. If the gaming system determines that the primary triggering event occurred, the gaming system selects one of the players based on the previous designated wagers of such players relative to the other players' designated wagers and the gaming system causes the primary progressive award to be provided to the selected player.

Continuing with this embodiment, after the occurrence of the primary triggering event, the gaming system also provides the players (including the selected player) with an opportunity to win at least one of the secondary progressive awards. In one such embodiment, after the occurrence of the primary triggering event, the gaming system assigns each of the players to different progressive event tiers or groups based on the relative quantity of progressive event points accumulated by each one of the players. In one embodiment, each progressive event tier or group is associated with a different range of accumulated progressive event points and a different one of the secondary progressive awards. The gaming system assigns each one of the players to one of the progressive event tiers or groups based on whether the player's accumulated quantity of progressive event points coincides with the range associated with the progressive event tier or group. The gaming system determines which of the secondary progressive awards that each of the players can win by assigning each one of the players to one of the progressive event tiers or groups associated with one of the secondary progressive awards.

After assigning each of the players to a progressive event tier or group, the gaming system determines which of the players assigned to each progressive event tier or group will be provided the secondary progressive award associated with that progressive event tier or group. In one embodiment, this determination is based on the players' last wager prior to the primary triggering event. For each progressive event tier or group, the gaming system determines which player or players in that progressive event tier win the associated secondary progressive award. The gaming system makes this determination in accordance with a probability of winning the associated secondary progressive award which is associated with each one of the players in the progressive event tier. That is, in this embodiment, the secondary progressive award which the player can win is based on the progressive event tier assigned to that player based on that player's accumulated quantity of progressive event points while the probability of that player winning such secondary progressive award is based on that player's previous designated wager relative to other players' previous designated wagers. In one embodiment, the gaming system associates a higher probability with those players that have wagered higher amounts.

If the primary progressive triggering event did not occur, the gaming system may still enable the player to win one or more secondary progressive awards. As mentioned above, each one of the secondary progressive awards is associated with a different secondary triggering event. If a secondary progressive award triggering event occurred, the gaming system assigns each one of the players to one of a plurality of different progressive event tiers or groups based on the accumulated quantity of progressive event points for each player. In one embodiment, a player qualifies or is eligible for this triggered secondary progressive award if that player has accumulated a designated quantity of progressive event points. For example, if a player has accumulated a quantity of progressive event points that is equal to or greater than the designated quantity of progressive event points, the gaming system enables that player to win the triggered secondary progressive award.

If the progressive event tier or group associated with the triggered secondary progressive award includes at least one assigned player, the gaming system determines which player within that tier or group will be provided with the triggered secondary progressive award. In one embodiment, this determination is based on each player's last wager prior to the primary triggering event. The gaming system determines which player or players in that progressive event tier or group win the triggered secondary progressive award in accordance with a probability of winning the triggered progressive award associated with that progressive event tier or group.

Accordingly, the gaming system and method disclosed herein provides at least one player with a chance to win one of the progressive awards based on the at least one player's wager while also providing the player with a chance to win one or more other progressive awards based on the at least one player's accumulated quantity of progressive event points. The disclosed gaming system and method further provides that the progressive award which the at least one player can win is based on the accumulated quantity of progressive event points for that player while the probability of the at least one player winning such progressive award is based on that player's previous designated wager relative to other players' previous designated wagers. That is, which progressive award is won by the at least one player is determined by the at least one player's accumulated quantity of progressive event points.

Additional features and advantages are described herein, and will be apparent from the following Detailed Description and the figures.

BRIEF DESCRIPTION OF THE FIGURES

FIG. 5A is one example of a chart in accordance with one embodiment of the disclosed gaming system which shows a plurality of players, the wagers placed by such players for a previous play of a game, and the probability to win a progressive award based on such wagers.

FIG. 5B is one example of a chart in accordance with one embodiment of the disclosed gaming system which shows a plurality of progressive event tiers or levels of accumulated progressive event points and a player's probability to win each individual progressive award based on such progressive event tiers or levels.

FIG. 6 is one example of a chart in accordance with one embodiment of the disclosed gaming system which shows a plurality of progressive event tiers or levels of accumulated progressive event points and a player's probability to win each individual progressive award based on such progressive event tiers or levels.

FIG. 8 is one example of a chart in accordance with one embodiment of the disclosed gaming system which shows a plurality of players eligible to win a primary progressive award, the wagers placed by such players for a previous play of a game, and the probability for each player to win the primary progressive award based on such wagers.

FIG. 9 is one example of a chart in accordance with one embodiment of the disclosed gaming system which shows a plurality of progressive event tiers or levels of accumulated progressive event points and a plurality of individual progressive awards associated with such progressive event tiers or levels.

FIG. 10A is one example of a chart in accordance with one embodiment of the disclosed gaming system which shows a plurality of different wager amounts, the number of players who qualified for a certain progressive award at each wager amount, and a probability to win the certain progressive award for each player at the different wager amounts.

FIG. 10B is one example of a chart in accordance with one embodiment of the disclosed gaming system which shows a plurality of players who qualified for a certain progressive award, the wagers placed by such players for a previous play of a game, and the probability for each player to win the certain progressive award based on such wagers.

FIG. 11A is one example of a chart in accordance with one embodiment of the disclosed gaming system which shows a plurality of progressive event tiers or levels of accumulated progressive event points, a progressive award associated with each tier or level, and the current value of the progressive awards.

FIG. 11B is one example of a chart in accordance with one embodiment of the disclosed gaming system which shows a plurality of different progressive event tiers or levels of progressive event accumulated points, the number of players who qualified for a certain progressive award at each progressive event tier or level, and the probability for each player of the progressive event tier or level to win the certain progressive award based on such points.

DETAILED DESCRIPTION

The present disclosure may be implemented in various configurations for gaming machines, gaming devices, or gaming systems, including but not limited to: (1) a dedicated gaming machine, gaming device, or gaming system wherein the computerized instructions for controlling any games (which are provided by the gaming machine or gaming device) are provided with the gaming machine or gaming device prior to delivery to a gaming establishment; and (2) a changeable gaming machine, gaming device, or gaming system wherein the computerized instructions for controlling any games (which are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
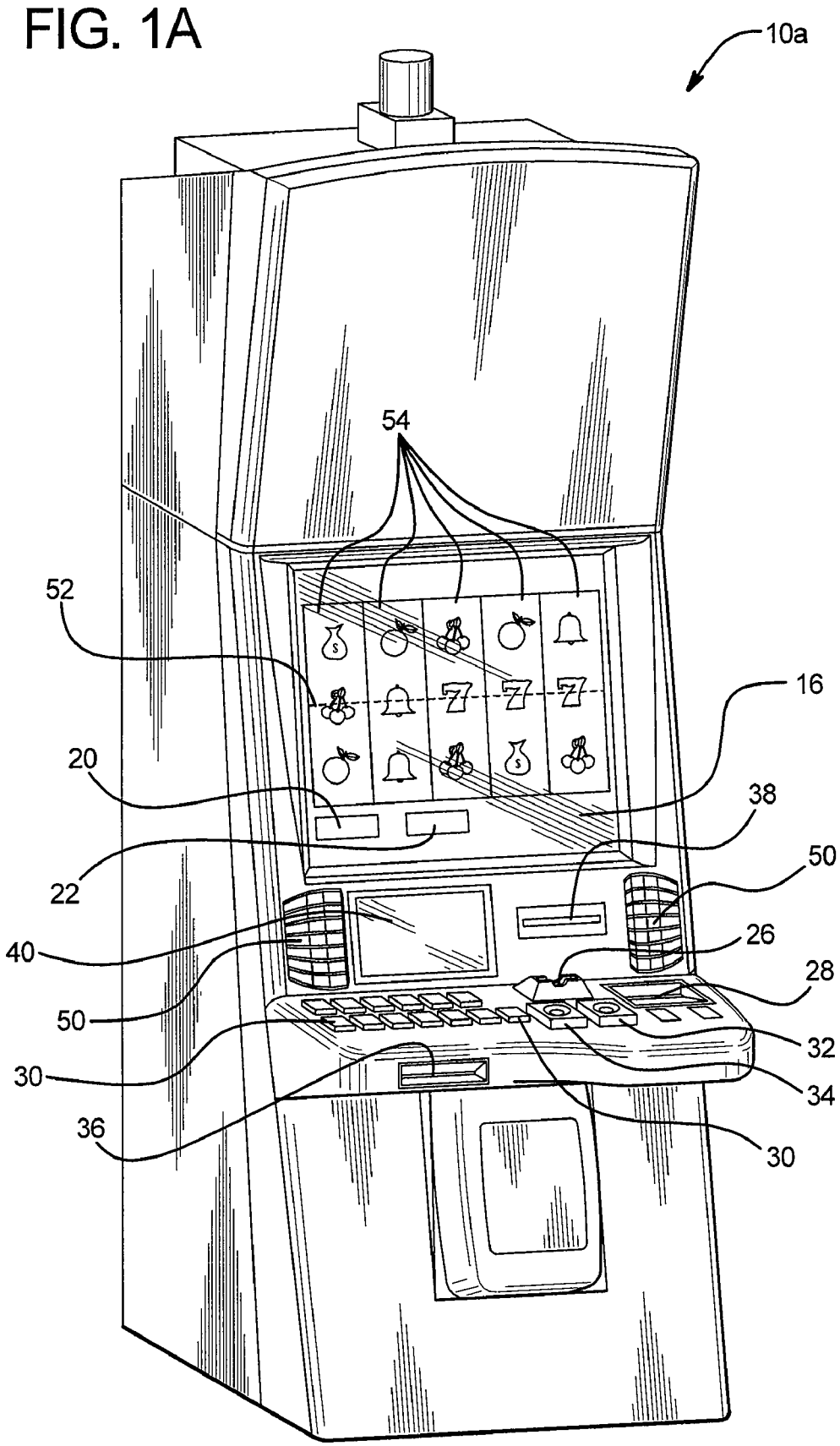
FIGS. 1A and 1B are perspective views of alternative embodiments of one of the gaming devices in the gaming system of the present disclosure.
Figure 1B:
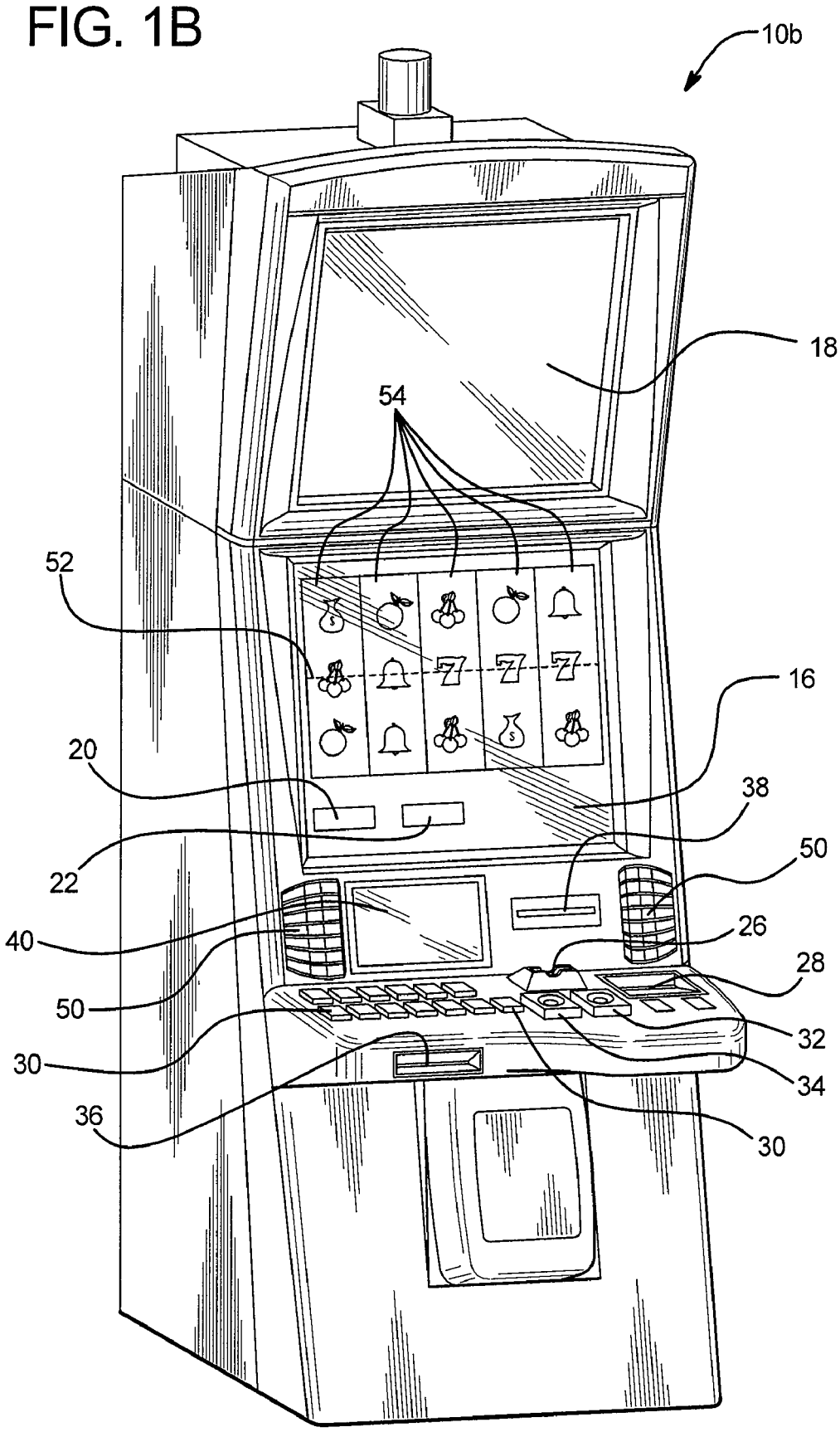

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet which provides support for a plurality of displays, inputs, controls, and other features of a conventional gaming machine. It is configured so that a player can operate it while standing or sitting. The gaming device can be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
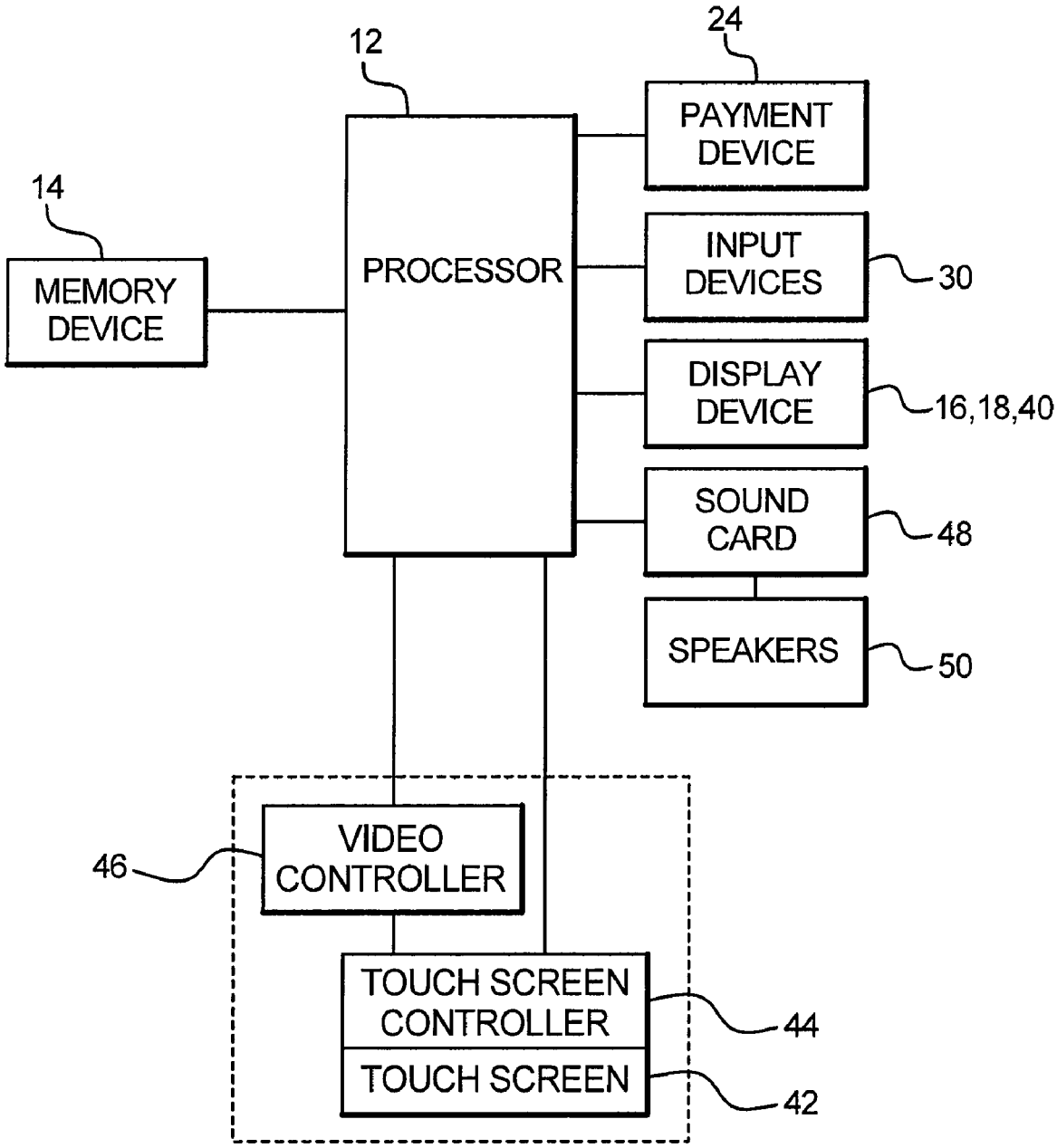
FIG. 2A is a schematic block diagram of one embodiment of an electronic configuration for one of the gaming devices disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which can include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device. In other embodiments, part or all of the program code and/or operating data described above can be downloaded to the memory device through a suitable network.

In one embodiment, an operator or a player can use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, for example part of a wireless gaming system. In this embodiment, the gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance, or the equivalent. In one embodiment, the gaming device includes a bet display 22 which displays a player's amount wagered. In one embodiment, as described in more detail below, the gaming device includes a player tracking display 40 which displays information regarding a player's play tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket, or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip, a coded magnetic strip or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, which communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B, and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card, may be implemented in accordance with the gaming device disclosed herein.

In one embodiment, as mentioned above and as seen in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player can make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as by playing music for the primary and/or secondary game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor), that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering game as the primary or base game. The gaming machine or device may include some or all of the features of conventional gaming machines or devices. The primary or base game may comprise any suitable reel-type game, card game, cascading or falling symbol game, number game, or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, displays the plurality of simulated video reels 54. Each reel 54 displays a plurality of indicia or symbols, such as bells, hearts, fruits, numbers, letters, bars, or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more than one or all of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to a quantity of awards being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the number of credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, a base or primary game may be a keno game wherein the gaming device displays a plurality of selectable indicia or numbers on at least one of the display devices. In this embodiment, the player selects at least one bit potentially a plurality of the selectable indicia or numbers via an input device such as a touch screen. The gaming device then displays a series of drawn numbers and determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or in a bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game, and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition occurs based on exceeding a certain amount of game play (such as number of games, number of credits, amount of time), or reaching a specified number of points earned during game play.

In another embodiment, the gaming device processor 12 or central controller 56 randomly provides the player one or more plays of one or more secondary games. In one such embodiment, the gaming device does not provide any apparent reason to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather they must win or earn entry through play of the primary game, thus encouraging play of the primary game. In another embodiment, qualification of the bonus or secondary game is accomplished through a simple "buy-in" by the player—for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
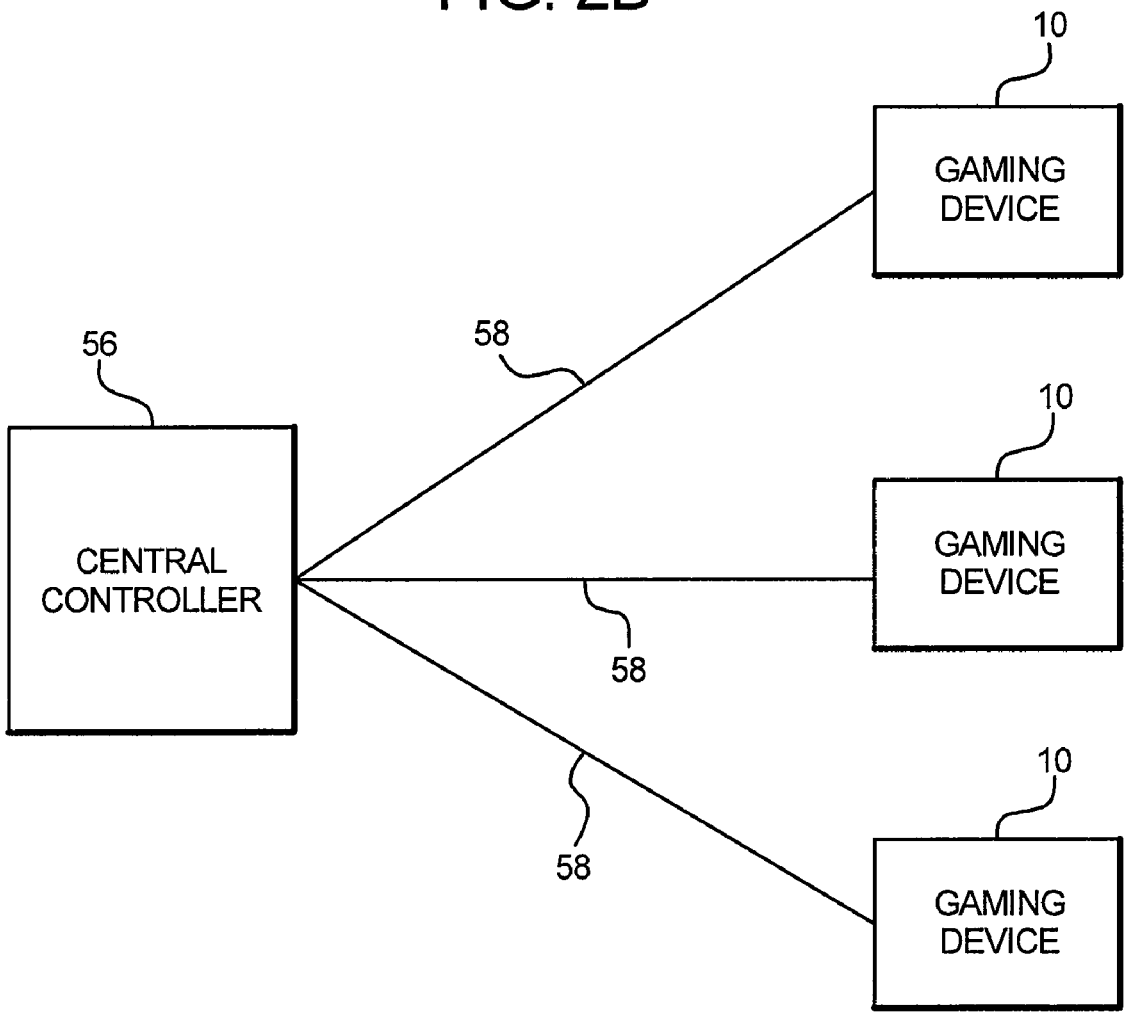
FIG. 2B is a schematic block diagram of one embodiment of a gaming system network configuration including a plurality of gaming devices disclosed herein.

In one embodiment, as illustrated in FIG. 2B, one or more of the gaming devices 10 are in communication with each other and/or at least one central controller 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more or each of the functions of the central controller, central server or remote host as disclosed herein may be performed by one or more gaming device processors. It should be further appreciated that one, more or each of the functions of one or more gaming device processors as disclosed herein may be performed by the central controller, central server or remote host.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno or lottery game is not displayed to the player, but the results of the bingo, keno, or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game, and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

In one embodiment, a plurality of gaming devices at one or more gaming sites are networked to the central server in a progressive configuration, wherein a portion of each wager to initiate a base or primary game is allocated to one or more progressive awards. In one embodiment, a progressive gaming system host site computer is coupled to a plurality of the central servers at a variety of mutually remote gaming sites for providing a multi-site linked progressive automated gaming system. In one embodiment, the progressive gaming system host site computer serves gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine triggers progressive award wins. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven progressive award triggering event. In other embodiments, the progressive award triggering event or qualifying condition may be achieved by exceeding a certain amount of game play (such as number of games, number of credits, or amount of time), or reaching a specified number of progressive event points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, the gaming system includes or maintains a plurality of different progressive awards which can be won by one or more players at the gaming devices in the gaming system. In one embodiment, the progressive awards start at the same default level, such as $0 or $1000, and increment or increase until provided to one of the players. In another embodiment, the progressive awards increment from the default level based on a percentage (such as 0.01%, 0.5% or 1%) of coin-in or wagered amounts by the player. The default level and the percentage of coin-in or wagered amounts for each progressive award is predetermined and the gaming system implementer can set the percentage of coin-in or wagered amounts for each progressive award to any suitable value or level. In one embodiment, the percentage that goes to each progressive award is unequal. It should be appreciated that any suitable increment levels may be employed and that the ranges for the increments may vary and depending on the minimum wager levels and the number of progressive awards. Unequal percentages of coin-in or wagered amounts enable a first progressive award to accrue at a different rate (e.g., faster or slower) than a second progressive award. For example, a progressive award with a higher value or at a higher level within a multi-level progressive award may increment at a higher rate than a progressive award with a lower value. Alternatively, the percentage that goes to each progressive award is equal (such as 0.1% to each of the progressive awards).

At least a fraction of one or more progressive awards may be funded by the casino, such as through one or more of the casino's marketing and/or advertising departments, by using a starting value higher than zero to make the progressive awards attractive even after they are reset. In another embodiment, at least one progressive award is funded by the casino, such as through one or more of the casino's marketing and/or advertising departments. In these embodiments, the gaming system increments the progressive award levels until a progressive award is provided to a player (upon the occurrence of a progressive award triggering event), at which point the progressive award is reset and another progressive award starts incrementing from the appropriate default progressive award level.

In another embodiment, two or more of the progressive awards may be funded at different temporal rates. In this embodiment, the different progressive awards are incremented or funded in different increments of time wherein until one of the progressive awards is provided to a player, a set amount is added to the progressive at each determined time increment. In another embodiment, two or more of the progressive awards are each incremented or funded based on different incrementing factors or incrementors. In this embodiment, a first one of the progressive awards increments each time a first incrementing factor occurs and a second one of the progressive awards may increment each time a second incrementing factor occurs. In one such embodiment, the first incrementing factor is different from the second incrementing factor. In different embodiments, the incrementing factors includes, but are not limited to symbol-driven events in the primary game, random events in the primary game or the bonus game, player selectable events in the bonus game, the player betting a maximum amount, a designated number of gaming devices in the gaming system being actively played by one of the players (e.g., in active status), a side-wager, or any other suitable method for defining an incrementor.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

Tiered Progressive Awards

In one embodiment, as illustrated in FIGS. 3, 4, 5A, and 5B, the gaming system enables a plurality of players playing at gaming devices in the gaming system to each accumulate a quantity of progressive event points during a designated period of time. In this embodiment, the gaming system selects one of the players to win at least one of a plurality of progressive awards based on a designated wager or wager amount placed by each of the players during the designated period of time. After selecting one of the players, the gaming system determines which one of the progressive awards to provide the selected player based on the quantity of progressive event points accumulated by the selected player during the designated period of time.

Figure 3:
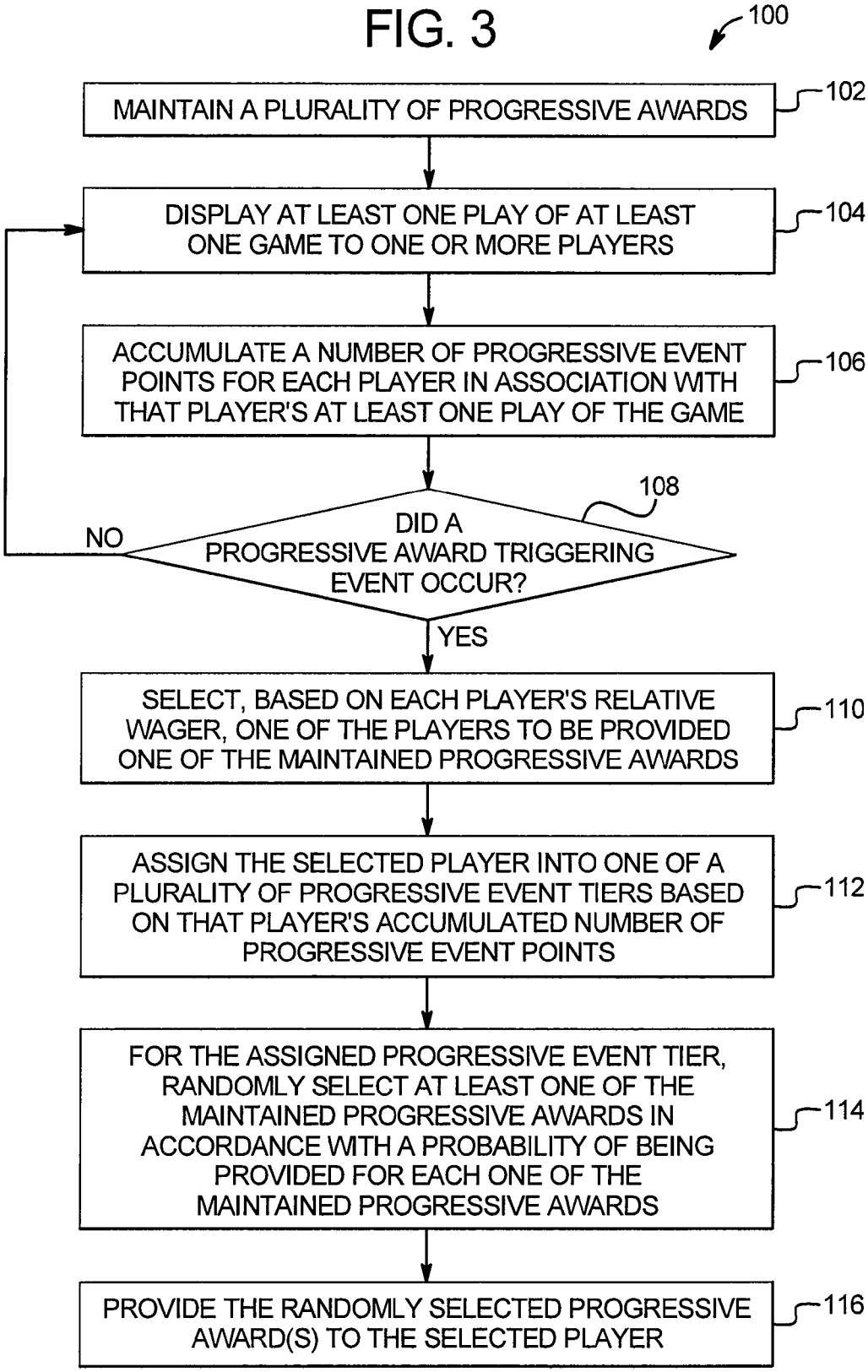
FIG. 3 is a process flow diagram showing one possible flow sequence of one embodiment of the disclosed gaming system.

Referring now to FIG. 3, a flowchart of an example process 100 for operating a gaming system or a gaming device disclosed herein is illustrated. In one embodiment, the process 100 is embodied in one or more software programs stored in one or more memories and executed by one or more processors or controllers. Although the process 100 is described with reference to the flowchart illustrated in FIG. 3, it should be appreciated that many other methods of performing the acts associated with process 100 may be used. For example, the order of certain of the blocks described may be changed, or certain of the blocks described may be optional.

In operation of this embodiment, the gaming system maintains a plurality of progressive awards as indicated by block 102. In one embodiment, the progressive awards are arranged as a multi-level progressive award. Each of the gaming devices in the gaming system is associated with at least one of the maintained progressive awards. The gaming devices each enable a plurality of players to play one or more games. For each play of the game displayed by one of the gaming devices in the gaming system, the player at that gaming device places a wager, as indicated by block 104. In one embodiment, a plurality of different gaming devices display a plurality of different games, such as different primary games.

The gaming system accumulates a number of progressive event points for each player, as indicated by block 106. In this embodiment, the gaming system enables each player to accumulate a number of progressive event points in association with each play of the game at that player's gaming device. For each of the gaming devices which generates a designated symbol or symbol combination in the play of the game, the gaming system provides a designated quantity of progressive event points to the player of that gaming device. That is, the generation or occurrence of the designated symbol or symbol combination constitutes a symbol-driven progressive event point accumulation condition. For example, each occurrence or generation of a first designated symbol combination is associated with a first quantity of progressive event points and each occurrence or generation of a second, different designated symbol combination is associated with a second, different quantity of progressive event points. In this embodiment, the quantity of progressive event points accumulated by each player is earned during game play.

In another embodiment, a progressive event point accumulation condition or event occurs independent of any displayed event in any play of any game of any of the gaming devices in the gaming system. In another embodiment, the gaming system tracks the occurrences of one or more suitable events occurring at or in association with one or more players and/or one or more gaming devices in the gaming system and determines, based on these tracked events, whether a progressive event point accumulation condition has occurred. In another embodiment, the gaming system defines one or more game play parameters, wherein each time a player's tracked game play activity satisfies the defined parameter, a progressive event point accumulation condition occurs. In another embodiment, a player tracking status increases or decreases the accumulation rate for the number of progressive event points. That is, in one embodiment, a player having a first player tracking status (e.g., uncarded or bronze) accumulates progressive event points at a different rate than a player having a second player tracking status (e.g., silver or gold).

Figure 4:
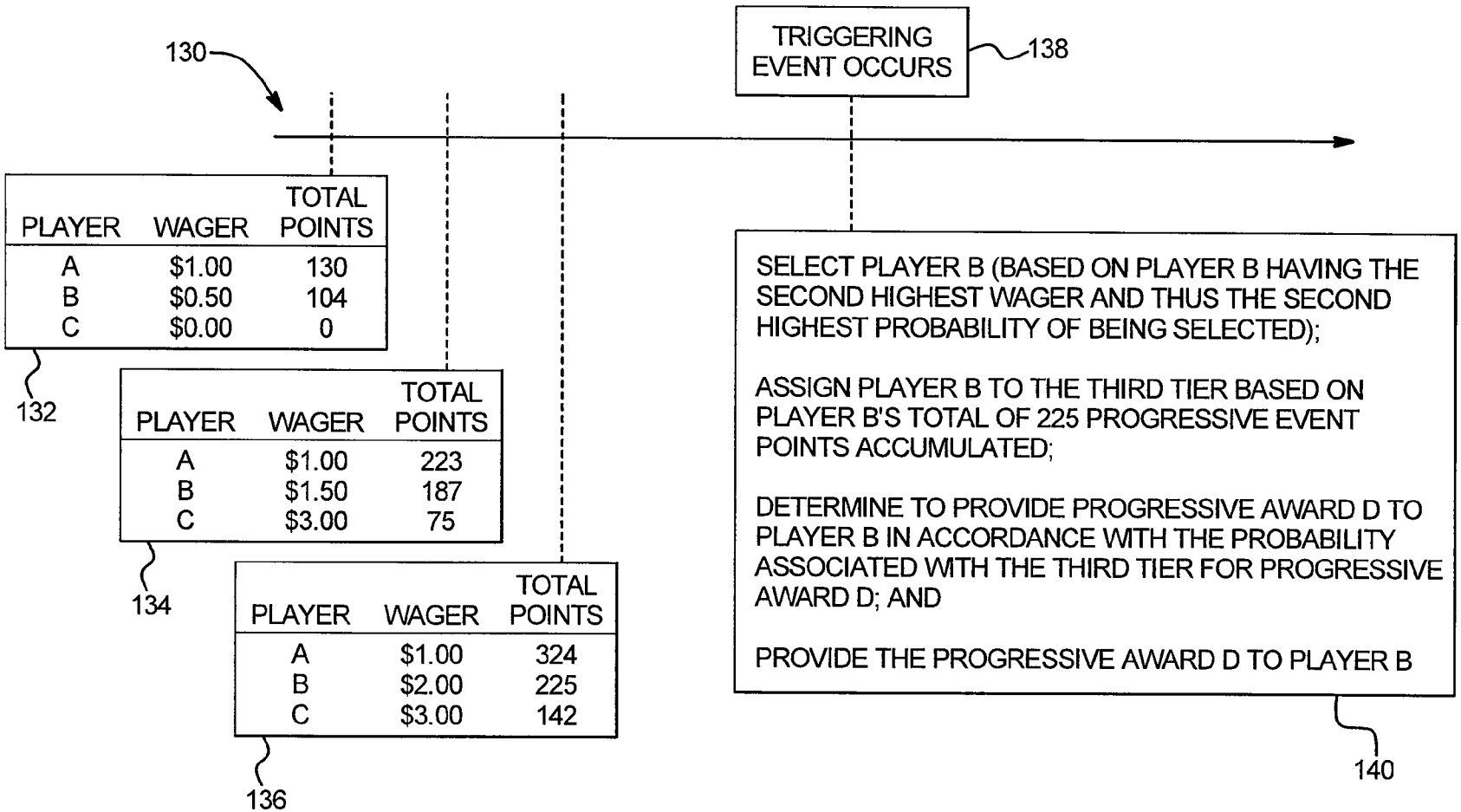
FIG. 4 is one example of a timeline showing the operation of one embodiment of the disclosed gaming system.

Referring now to FIG. 4, timeline 130 shows the gaming system tracking each wager placed by each of a plurality of players and any progressive event points accumulated by each of those players at different points 132, 134, and 136 along the timeline 130. For example, at point 136, Players A, B and C each placed a wager of $1.00, $2.00, and $3.00 for a play of the primary game at a respective one of the gaming devices. At this point in time, Player A has accumulated three-hundred-twenty-four progressive event points, Player B has accumulated two-hundred-twenty-five progressive event points and Player C has accumulated one-hundred-forty-two progressive event points.

In one embodiment, the gaming system stores each of the players' wagers, wager history and/or accumulated progressive event points in association with a player account associated with a suitable player tracking and/or management system. In this embodiment, if a player doesn't have an existing player account with the suitable player tracking and/or management system, the gaming system and/or the suitable player tracking and/or management system enables the player to establish a new player account. Registering or creating the new player account includes, but is not limited to, the player making inputs relating to information regarding the player's identity (e.g., name, age, location, or biometric profile) and/or the player's financial details (e.g., credit status, bank information or credit card number). In this embodiment, the player account includes, but is not limited to, player information, gaming device information, financial information and a verification mechanism, such as a password, player biometric details, personal identification number (i.e., a PIN), hardware details or any suitable combination thereof. In one embodiment, the gaming system and/or the suitable player tracking and/or management system controls a verification process each time one of the players tries to access their player account (e.g., the gaming system and/or the suitable player tracking and/or management system requests that player to enter a PIN number or password).

In one such embodiment, the gaming system stores a player's identification, wagers, wager history, accumulated progressive event points, credit totals (or related data), and/or other relevant information in association with individual identification cards and/or individual player tracking cards associated with a suitable player tracking system. In this embodiment, the gaming system enables the player to accumulate a number of progressive event points at one or more of the gaming devices (e.g., at the same gaming device or at different gaming devices) by storing the accumulated number of progressive event points on the player's identification card or player tracking card. In another such embodiment, the gaming system enables one of the players to cause one of the gaming devices to print that player's identification, wagers, wager history, accumulated progressive event points, credit totals (or related data), and/or other relevant information on a ticket or voucher. As described above, if the player inserts the ticket or voucher into the note, ticket or bill acceptor of one of the gaming devices in the gaming system, that gaming device reads the ticket or voucher and enables the player to access any progressive event points accumulated by that player. That is, the gaming system enables the player to access any stored progressive event points and accumulates additional progressive event points at one or more of the gaming devices in the gaming system (e.g., at the same gaming device or at different gaming devices). In another embodiment, the gaming system stores the accumulated number of progressive event points for each gaming device independent of the player or players who have played at that gaming device.

In addition to accumulating progressive event points for one or more players, the gaming system determines whether a designated triggering event occurs, as indicated by the block 108. If the designated triggering event does not occur, the gaming system continues monitoring subsequent plays of the primary games until a designated progressive award triggering event occurs.

In one embodiment, the designated triggering event is associated with the plurality of maintained progressive awards as indicated by block 102 such that if the triggering event occurs, the gaming system enables one or more of the players to win at least one of the maintained progressive awards. That is, if the designated triggering event occurs, the gaming system selects at least one of the players playing at the gaming devices in the gaming system to be provided one or more of the maintained progressive awards, as indicated by block 110. The gaming system determines which of the players playing at the gaming devices in the gaming system are eligible to win one of the progressive awards. In one embodiment, the gaming system enables all of the players playing at the gaming devices in the gaming system to be eligible to win one of the progressive awards. In another embodiment, the gaming system limits the eligibility to certain players based on a certain criterion (such as the player's player tracking status as determined through a suitable player tracking system). In another embodiment, the gaming system determines which players are eligible to win one or more of the progressive awards based on exceeding a certain amount of game play (such as number of games, number of credits, amount of time), or reaching a specified number of progressive event points earned during game play.

Referring now to point 136 along the timeline 130 in FIG. 4 and chart 150 illustrated in FIG. 5A, the gaming system selects the at least one player based on that player's designated wager or wager amount during a designated period of time (e.g., the player's last or most recent wager amount prior to the designated triggering event). That is, each player's recent wagering activity during the designated period of time determines the player's probability to be selected by the gaming system to win one or more of the maintained progressive awards. For example, the gaming system selects players who have wagered higher amounts prior to the designated triggering event more frequently (i.e., in accordance with a higher probability of being selected by the gaming system) to win one or more of the maintained progressive awards. In one example, the gaming system selects one of the players playing at one of the gaming devices during the designated period of time based on the designated wager amounts placed by that player prior to the occurrence of the designated triggering event relative to the designated wager amounts placed by the other players prior to the occurrence of the designated triggering event. In another embodiment, the gaming device determines each of the player's probability to be selected to win one or more of the maintained progressive awards based on a number of each players' wagers or wager amounts during the designated period of time. For example, the gaming system averages each of the player's last three wagers prior to the designated triggering event to determine each player's probability to be selected by the gaming system.

In one embodiment, after the occurrence of the triggering event, the gaming device determines whether each of the player's designated wagers or wager amounts occurred during a designated period of time (e.g., a predetermined period of time prior to the designated triggering event). For each one of the players, if the gaming system determines that the player's designated wager or wager amount occurred during the designated period of time, the gaming system selects that player to win at least one of the progressive awards and locks up the gaming device being played by that player. In this embodiment, the gaming system keeps the gaming device locked until one or more of the progressive awards is provided to the selected player. That is, the gaming system unlocks the selected player's gaming device to commence a new primary game after the gaming device causes one of the progressive awards to be provided to the selected player.

As illustrated at point in time 136 illustrated in FIG. 4. As illustrated, at this point in time, Player C has wagered $3.00, which is higher than the wagers placed by Players A and B, and thus Player C has a higher probability of being selected by the gaming system to win one of the maintained progressive awards than either Player A or Player B. That is, in this embodiment, the selected player is associated with a probability to win at least one of the maintained progressive awards and the gaming system bases the probability of winning each of the maintained progressive awards on the selected player's last or most recent wager amount during a designated period of time prior to the designated progressive award triggering event.

After selecting one of the players, the gaming system assigns the selected player to one of a plurality of tiers or levels based on that player's accumulated quantity of progressive event points, as indicated by block 112 of FIG. 3 and also chart 160 of FIG. 5B. That is, based on the selected player's accumulated number of progressive event points, the gaming system determines which progressive event tier or level to assign the selected player. As illustrated by chart 160, each progressive event tier or level is associated with a different quantity or range of points so that the gaming system does not assign the same player to multiple progressive event tiers or levels. That is, in this embodiment, each progressive event tier or level is associated with a different minimum point value and a different maximum point value. Based on the selected player's accumulated quantity of progressive event points, the gaming system assigns the selected player into one of the progressive event tiers.

After the gaming system assigns the player to one of the progressive event tiers, the gaming system randomly selects one of the maintained progressive awards to provide to the selected player, as indicated by block 114. The gaming system makes this random selection in accordance with a probability of being provided for each one of the maintained progressive awards based on the selected player's assigned tier. That is, the gaming system determines the selected player's chance or likelihood to win any one or more of the progressive awards based on the selected player's assigned tier.

As illustrated in FIG. 5B, chart 160 shows a probability for the selected player to win any one of the maintained progressive awards (e.g., Progressive Award A, Progressive Award B, Progressive Awards A and B, Progressive Award C, and Progressive Award D) based on the selected player's assigned tier. The selected player's chance or likelihood to win a first one of the progressive awards (e.g., Progressive Award A) increases between different tiers while the selected player's chance or likelihood to win a second one of the progressive awards (e.g., Progressive D) decreases between different tiers. Associating different probabilities for one or more of the progressive awards for different progressive event tiers enables the gaming system implementer to set each one of the maintained progressive awards to different values which will be provided at different frequencies.

In the example illustrated by chart 160, if the gaming system assigns the selected player to the first tier (e.g., the selected player has accumulated between zero and forty-nine progressive award points), the gaming system determines that the selected player has a probability of 0.005% to win Progressive Award A. If the gaming system assigns the selected player to the second tier (e.g., the selected player has accumulated between fifty and one-hundred-ninety-nine progressive award points), the gaming system determines that the selected player has a probability of 0.25% to win Progressive Award A. The selected player has an opportunity to win any one or more of the progressive awards regardless of which tier the gaming system assigns the selected player.

As illustrated by block 114 of FIG. 3 and chart 160 of FIG. 5B, the gaming system makes one determination for the plurality of progressive awards. That is, in this embodiment, the gaming system randomly selects at least one of the maintained progressive awards (e.g., Progressive Award A or Progressive Award B) from the plurality of maintained progressive awards (e.g., Progressive Award A, Progressive Award B, Progressive Awards A and B, Progressive Award C, and Progressive Award D) to provide to the selected player in accordance with the selected player's chance or likelihood to win such progressive awards based on the selected player's assigned progressive event tier. It should be appreciated that the gaming system can implement many different ways to determine whether the selected player will win one or more of the progressive awards and to determine which, if any, of the progressive awards the selected player will win based on such probability data associated with the selected player's assigned progressive event tier.

After the gaming system selects which one or more of the progressive awards to provide to the selected player, the gaming system causes one of the gaming devices to provide the one or more progressive awards to the selected player, as indicated by block 116. That is, in accordance with the probabilities of winning the progressive awards that are associated with the selected player's assigned tier, the gaming system selects which one or more of the progressive awards to provide to the selected player.

Referring back to timeline 130 illustrated in FIG. 4 and charts 150 and 160 of FIGS. 5A and 5B, after the triggering event occurs at 138, the gaming system selects one of the players (e.g., player B) based on that player's previous designated wager relative to other players' previous designated wagers prior to the triggering event. As illustrated by chart 150, Player B had placed the second highest wager prior to the triggering event and thus, Player B had the second highest probability of being selected to win one of the maintained progressive awards from the group of eligible players (e.g., Players A, B and C). After the gaming system selects Player B, the gaming system determines that Player B had accumulated a total of two-hundred-twenty-five progressive event points prior to the occurrence of the triggering event (at point of time 136 in FIG. 4). Based on this accumulated quantity of progressive points, the gaming system assigns Player B to the third tier of progressive event points illustrated by chart 160 in FIG. 5B. Based on the assigned third tier, as illustrated by chart 160, Player B has an opportunity to win a plurality of the maintained progressive awards. For example, Player B has a 1% probability to win Progressive Award A, a 2% probability to win Progressive Award B, a 40% probability to win Progressive Award C, and a 57% probability to win Progressive Award D. In accordance with these probabilities, the gaming system determined to provide Progressive Award D to Player B as illustrated at point 140 along the timeline 130 in FIG. 4.

In one embodiment, the gaming system resets any progressive event points accumulated for each of the players after the designated triggering event occurs. In another embodiment, the gaming system only resets the progressive event points accumulated for the player selected to win one or more of the progressive awards after the designated triggering event occurs while any progressive event points accumulated for the other players remain available and active for a second designated triggering event. That is, in one such embodiment, the gaming system resets some but not all of the players accumulated quantity of progressive event points after the designated triggering event occurs.

In one embodiment, based on the accumulated quantity of progressive event points for each of the players, the gaming system tiers the selected player by placing or assigning the selected player to one of a plurality of different progressive event tiers or levels. In this embodiment, each of the progressive event tiers or levels is associated with an individual probability of the selected player winning each one of the progressive awards. After the triggering event occurs, the gaming system separately determines whether to provide each one of the progressive awards to the selected player in accordance with the probability associated with that progressive award and the selected player's progressive event tier. That is, for each progressive award, the gaming system determines whether to provide that progressive award to the selected player in accordance with the probability associated with that progressive award for the selected player's progressive event tier or level. In one such embodiment, the selected player's likelihood to win a designated one or more of the progressive awards is based on that player's assigned progressive event tier or level, which in turn, is based on the selected player's accumulated quantity of points.

In the embodiment illustrated in FIGS. 3, 4, 5A, and 5B, the gaming system determines which one of the players playing at the gaming devices in the gaming system will be provided one or more of the progressive awards based on the wagers placed by those players while playing at the gaming devices. That is, for each player, the gaming device determines whether that player will be provided one or more progressive awards based on that player's wagering activity. After the gaming system determines the player that will be provided one or more of the progressive awards, the gaming system determines which one of the progressive awards the determined player will win based on the probability data associated with each of the progressive awards and the determined player's assigned tier.

It should be appreciated that the gaming system operator or implementer can associate any number of maintained progressive awards and any number of progressive event tiers. It should be also be appreciated that the gaming system operator or implementer can associate any probability for each of the maintained progressive awards with each one of the progressive event tiers. It should also be appreciated that the gaming system operator can associate any quantity or range of progressive event points with each one of the progressive event tiers.

In one embodiment, the gaming system selects one of the players to win at least one of a plurality of progressive awards and assigns the selected player to one of a plurality of progressive event tiers or levels based on the quantity of progressive event points accumulated by the selected player. Based on the selected player's assigned tier, as illustrated by the chart 170 in FIG. 6, the gaming system determines which one or more of the progressive awards are available to the selected player. Chart 170 illustrates one example which shows a plurality of progressive event tiers or levels of accumulated progressive event points and the selected player's probability to win at least one progressive award based on such progressive event tiers or levels. In this embodiment, a first progressive event tier or level (e.g., the progressive event tier or level associated with zero to forty-nine points) is associated with a designated quantity of progressive awards (e.g., progressive award D). Based on the quantity of progressive event points accumulated by the selected player, the player qualifies for different progressive event tiers or levels and the gaming system enables that player to win additional progressive awards. As illustrated in FIG. 6, chart 170 shows that if the player qualifies for the fourth progressive event tier or level (e.g., the progressive event tier or level associated with at least four-hundred progressive event points), the gaming system enables that player to win any one of the maintained progressive awards (e.g., progressive award A, progressive award B, both progressive awards A and B, progressive award C or progressive award D). In this embodiment, the gaming system maintains a plurality of progressive awards wherein at least one of the progressive awards remain unavailable to certain players at certain progressive event tiers or levels while other progressive awards remain available for the players at such progressive event tiers or levels.

For example, if a player has accumulated two-hundred-fifty progressive event points, the gaming system tiers the player by placing or assigning the player to one of a plurality of different progressive event tiers or levels. In this example, the gaming system assigns the player to the third progressive event tier which is associated with a range of two-hundred to three-hundred-ninety-nine progressive event points. The third progressive event tier or level is also associated with an individual probability of the player winning a plurality of the maintained progressive awards. In this example, as illustrated by chart 170 in FIG. 6, the gaming system enables the player to win progressive award B, progressive award C and progressive award D based on that player's assigned progressive event tier or level. It should be appreciated that based on the player's assigned progressive event tier or level, at least one of the progressive awards (e.g., progressive award A and progressive awards A and B) remain unavailable to the player while other progressive awards (e.g., progressive award B, progressive award C and progressive award D) remain available for the player at the third progressive event tier or level.

Figure 7:
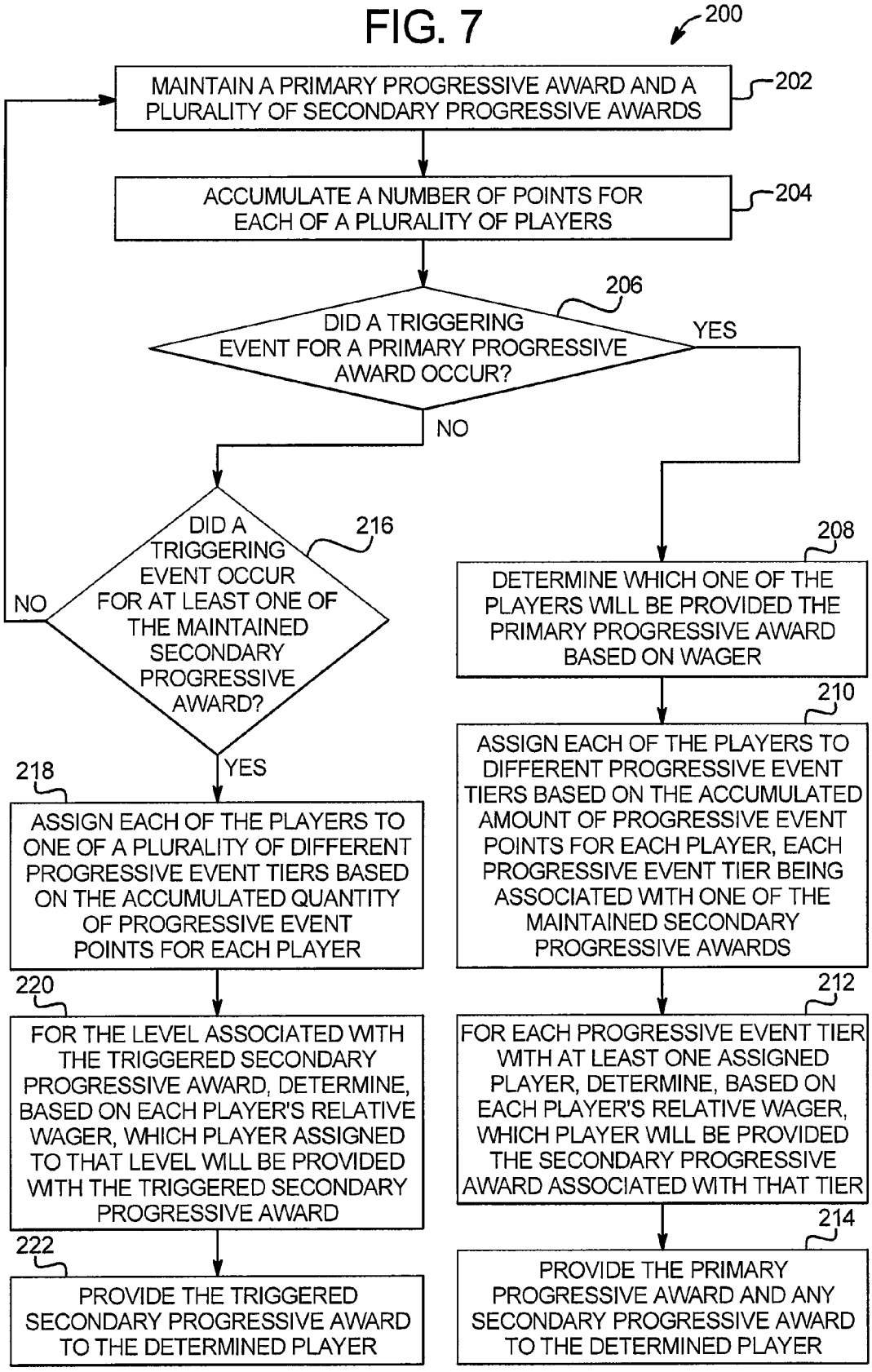
FIG. 7 is a process flow diagram showing one possible flow sequence of one embodiment of the disclosed gaming system.

In another embodiment, as illustrated in FIG. 7, the gaming system uses an accumulated quantity of progressive points for a designated player to determine which one or more of the progressive awards the designated player will win. In this embodiment, after a designated triggering event, the gaming system assigns a plurality of players playing at a plurality of gaming devices in the gaming system to a plurality of progressive event tiers and determines which one or more of the progressive awards the designated player will win based on the tier assigned to the designated player.

FIG. 7 shows a flowchart of an example process 200 for operating a gaming system or a gaming device disclosed herein is illustrated. In one embodiment, the process 200 is embodied in one or more software programs stored in one or more memories and executed by one or more processors or controllers. Although the process 200 is described with reference to the flowchart illustrated in FIG. 7, it should be appreciated that many other methods of performing the acts associated with process 200 may be used. For example, the order of certain of the blocks described may be changed, or certain of the blocks described may be optional.

In operation of one embodiment, the gaming system maintains a plurality of progressive awards, as indicated by block 202. In one embodiment, the gaming system maintains a primary progressive award and a plurality of secondary progressive awards. In one such embodiment, the primary progressive award is associated with a primary triggering event and each one of the secondary progressive awards is associated with a different secondary triggering event. In one embodiment, at least one of the secondary progressive awards is also associated with the primary triggering event. As described above, the gaming system accumulates a number of progressive event points for each player in association with the plays of the games, as indicated by block 204. In one embodiment, for each of the gaming machines which generates a designated symbol or symbol combination in the play of the game, the gaming system provides a designated quantity of progressive event points to the player of that gaming device. That is, in one such embodiment, the quantity of progressive event points provided to each player is symbol-driven and earned during game play.

As indicated by block 206, the gaming system determines whether the primary triggering event occurs. If the gaming system determines that the primary triggering event occurred, the gaming system determines which one of the players will be provided the primary progressive award based on the wagers of such players and the gaming system causes the primary progressive award to be provided to the selected player.

In one embodiment, the progressive award triggering event is based on time. In this embodiment, the gaming system implements a progressive award triggering event algorithm which increments a progressive award triggering event meter such that the gaming system provides a designated progressive award to at least one of the players by a designated time. The progressive award triggering event algorithm determines an amount to increment the progressive award triggering event meter independent of coin-in. That is, in one embodiment, the gaming system increments the progressive award triggering event meter at any time. Based on the meter value of the progressive award triggering event meter, the gaming system randomly selects a value that will trigger the designated progressive award. Once the progressive award triggering event meter increments to the randomly selected value, the gaming system causes the designated progressive award to be provided at that time. For example, if the progressive award triggering event meter takes thirty days to reach a designated meter value, the gaming system picks a value or time duration which corresponds to the thirtieth day such that the gaming system provides the designated progressive award on or around the thirtieth day.

In another embodiment, the gaming system implements a progressive award triggering event algorithm which determines a period of time in which the gaming system will provide the designated progressive award. For example, the progressive award triggering event algorithm determines that the gaming system will provide the designated progressive award within a thirty day period of time. In this embodiment, the progressive award triggering event algorithm assigns a probability for each time value within the period of time. For example, for a thirty day period of time, the progressive award triggering event algorithm assigns a designated probability (e.g., a probability of 1/30) for each day. In this example, the gaming system, utilizing the progressive award triggering event algorithm, determines whether the designated progressive award triggering event occurs for each day during the period or window based on the assigned probability. In this example, the gaming system provides a designated progressive award to at least one of the players by a designated time (e.g., during the thirty day period of time).

In this embodiment, the gaming system provides the players with an opportunity to win at least one of the secondary progressive awards after the primary triggering event occurred. After the primary triggering event occurs, the gaming system assigns each of the players to different tiers or groups based on each of the player's accumulated quantity of points, as indicated by block 210. In one embodiment, each tier or group is associated with a different range of accumulated points and a different one of the secondary progressive awards. For example, in this embodiment, the gaming system assigns each one of the players to one of the tiers or groups based on whether the player's accumulated quantity of progressive event points coincides with the range associated with the tier or group. The gaming system determines the secondary progressive award that each of the players can win by assigning the players to one of the tiers or groups.

After assigning each of the players to a tier or group, the gaming system determines which of the players assigned to each tier or group will be provided the secondary progressive award associated with that tier or group, as indicated by block 212. In one embodiment, for each tier or group, this determination is based on a designated wager or a designated wager amount placed by each of the players during a designated period of time. For example, this determination is based on the players' last wager prior to the primary triggering event. In one such embodiment, the gaming system associates a probability of winning the secondary progressive award with each one of the players of each one of the tiers or groups. The gaming system determines which player or players win any of the secondary progressive awards based on these probabilities. That is, in this embodiment, the secondary progressive award which the player can win is based on the accumulated quantity of progressive event points for that player and the probability of the player winning such secondary progressive award is based on the player's wager.

As indicated by block 214, the gaming system provides or causes one of the gaming devices to provide the primary progressive award and any secondary progressive awards to the players determined at block 212. That is, for each tier or group assigned at least one player, the gaming system determines which player or players of the tier or group will win the secondary progressive award associated with the tier or group in accordance with the probabilities associated with each of the players assigned to the tier or group.

In one embodiment, if the primary progressive triggering event did not occur, as indicated by block 206, the gaming system may still enable the player to win one or more secondary progressive awards. As seen in FIG. 7, the gaming system determines whether or not any secondary progressive award triggering events occurred, as indicated by block 216. In one embodiment, each one of the secondary progressive awards is associated with a different secondary progressive award triggering event and the gaming system separately determines whether or not any of these secondary progressive award triggering events occurred. In one embodiment, if one of the secondary progressive award triggering events occurred, the gaming system tiers each one of the players to different tiers or groups based on the accumulated quantity of progressive event points for each player, as indicated by block 218.

In one embodiment, for the tier associated with the triggered secondary progressive award, the gaming system evaluates the tier to determine which player within each tier will be provided with the triggered secondary progressive award, as indicated by block 220. In one embodiment, this determination is based on the players' last designated wager amount relative to other players' last designated wager amounts prior to the primary triggering event. In one such embodiment, the gaming system associates a probability of winning the triggered secondary progressive award with each player in each one of the tiers or groups. That is, within the tier or level, each player is associated with a probability of winning the triggered secondary progressive award based on that player's last wager prior to the primary triggering event. The gaming system determines which player or players win the triggered secondary progressive award based on these probabilities.

As indicated by block 222, the gaming system provides or causes one of the gaming devices to provide the triggered secondary progressive award to the player determined at block 220. In one embodiment, the gaming system determines the player to be provided the triggered secondary progressive award based on each player's previous designated wager amount relative to the other players' previous designated wager amounts as further described below.

As described above, after the primary progressive award triggering event occurs, the gaming system determines which one of the players will be provided the primary progressive award based on each player's relative wager amount. Referring now to FIG. 8, a chart 230 is illustrated which shows the wager placed by each of a plurality of the players in the gaming system that are eligible to win the primary progressive award. Chart 230 shows the wager placed by each one of the players prior to the primary progressive award triggering event and that player's associated probability of winning the primary progressive award. That is, each player's probability represents that player's chance or likelihood to be selected by the gaming system to win the primary progressive award. As seen in FIG. 8, each player's probability to win one or more of the maintained progressive awards is based on that player's previous wager (e.g., the last wager prior to the triggering event). For example, as illustrated in FIG. 8, Players A, B, C and D are playing at gaming devices in the gaming system such that Player A places a $1 wager, Player B places a $2 wager, Player C places a $3 wager and Player D places a $4 wager for a play of a respective one of the games preceding the occurrence of the primary progressive award triggering event. As seen in FIG. 8, when the primary progressive award triggering event occurs, the gaming system associates Player D with a higher probability than Players A, B and C because Player D placed the highest wager in the play of the game preceding the triggering event. In one embodiment based on this example, a player's probability to win the primary progressive award is scaled to that player's last wager as described above. In one such embodiment, the gaming system enables the players of the gaming devices of the gaming system to increase their probability of being provided the primary progressive award based on the players' wager activity or history.

In one embodiment, the gaming system assigns each of the eligible players to one of a plurality of tiers or levels based on the quantity of progressive event points accumulated for each player. Referring now to FIG. 9, a chart 240 is illustrated which shows a plurality of secondary progressive awards arranged as a multi-level progressive award. Each progressive award for each level of the multi-level progressive award is associated with the plurality of tiers or levels of accumulated progressive event points. Each tier or level is associated with a different range of progressive event points. For example, as illustrated by chart 240, a first tier is associated with zero to ninety-nine progressive event points, a second tier is associated with one-hundred to two-hundred-ninety-nine progressive event points, a third tier is associated with three-hundred to five-hundred-ninety-nine progressive event points and a fourth tier is associated with at least six-hundred progressive event points. Based on the chart 240 shown in FIG. 9, if a player has accumulated eighty-five progressive event points, the gaming system assigns that player to the first tier and enables that player to win the first level progressive award (e.g., currently valued at $52.58).

The gaming system tracks how many players have been assigned to each progressive event tier or level. As illustrated in FIG. 10A, chart 250 shows that the gaming system has assigned one-hundred-eighty players to the third progressive event tier. Each of these players have an opportunity to win the third level progressive award associated with the third progressive event tier, which is currently valued at $5,621.73 (FIG. 9). For this progressive event tier, the gaming system evaluates the players' wagers to determine which player within each tier or group will be provided with the third level secondary progressive award. As further illustrated by chart 250 in FIG. 10A, the gaming device has determined that thirty players wagered a first wager amount (e.g., $1), sixty players wagered a second, higher amount (e.g., $2) and ninety players wagered a third, highest amount (e.g., $3) for the play of the game preceding the primary triggering event. The gaming system associates a first probability of winning the third level secondary progressive award with each of the thirty players who wagered the first wager amount. The gaming system associates a second probability of winning the third level secondary progressive award with each of the sixty players who wagered the second wager amount and associates a third probability of winning the third level secondary progressive award with each of the ninety players who wagered the third wager amount.

As further illustrated by chart 250 in FIG. 10A, each player's probability to win the third level progressive award increases based on the player's wager amount. For example, since the third wager amount (e.g., $3) is greater than the first and second wager amounts (e.g., $1 and $2), the ninety players who wagered the third wager amount have a greater probability of winning the third level secondary progressive award than the other players who wagered less than the third wager amount. That is, within the third progressive event tier or level, each player is associated with a probability of winning the triggered secondary progressive award and the probabilities are based on the wager amounts placed by those players prior to the primary triggering event. As described above, the gaming system determines which player or players from the third progressive event tier or level will win the third level secondary progressive award based on the probabilities.

As illustrated in FIGS. 9 and 10B, the gaming system evaluates the players' wagers within the first tier to determine which of these players will be provided with the first level secondary progressive award. As illustrated, the first level secondary progressive award is currently valued at $52.58. Chart 260 shows one example in which the gaming system has assigned a plurality of players to the first progressive event tier. For this example, at each designated wager amount, the gaming system has assigned each player who qualified for the first level progressive award based on their accumulated quantity of points. The gaming system evaluates each player's wager amount relative to other players' wager amounts to determine which player within the first progressive event tier will be provided with the first level secondary progressive award. For example, if a plurality of players qualified for the first level progressive award based on their accumulated quantity of progressive event points at a plurality of designated wager amounts, the gaming system assigns these players (e.g., Players A, B and C) to the first progressive event tier. In this example, Players A, B and C each have an opportunity to win the first level progressive award which is currently valued at $52.58. Players A, B and C each wagered different amounts prior to the primary progressive award triggering event. The gaming system has associated different probability of winning the first level progressive award to each of the Players A, B and C based on these different wager amounts. As illustrated by the chart 260, the probability to win the first level progressive award is scaled to each player's wager amount such that if the wager amount doubles, the player's probability to win the first level progressive award also doubles.

FIGS. 11A and 11B show an alternative embodiment of how the gaming system assigns one or more players to progressive event tiers as described above. As shown in the embodiment illustrated in FIG. 11A, chart 270 shows a plurality of tiers or groups based on each player's total coin-in over a designated period of time. Depending upon the amount of coin-in placed by each player, the gaming system assigns that player to one of the progressive event tiers. In this embodiment, each different progressive event tier of coin-in is associated with one of the different secondary progressive awards. That is, the gaming system assigns each of the players to one of the progressive event tiers based on each player's relative coin-in. In this embodiment, the gaming system determines which of the progressive awards the players are eligible for based on the tiers assigned to those players.

As illustrated in FIG. 11B, chart 280 shows the number of players who qualified for the third level progressive award. In this embodiment, the gaming system tiers the players based on the quantity of progressive event points accumulated for each player. As seen in chart 280, the quantity of progressive event points accumulated by each player determines the player's probability to win the third level progressive award. For example, chart 280 shows that one-hundred-twenty-five players qualified for the third level progressive award by placing between $500 and $999 total coin-in. Of these players, fifty players had accumulated ninety-nine points or less, ninety players had accumulated had between one-hundred and two-hundred-ninety-nine points and one-hundred-twenty-five players had accumulated at least three-hundred points. In the illustrated embodiment, each of fifty players in the first tier (e.g., who had accumulated ninety-nine points or less) is associated with a first probability (e.g., 0.1%), each of ninety players in the second tier (e.g., who had accumulated ninety-nine points or less) is associated with a second, different probability and each of the one-hundred-twenty-five players in the third tier (e.g., who had accumulated at least three-hundred points) is associated with a third probability. Chart 280 shows that the players who have accumulated three-hundred or more points have a better chance at winning the third level progressive award than the players who have accumulated less points.

Figure 12:
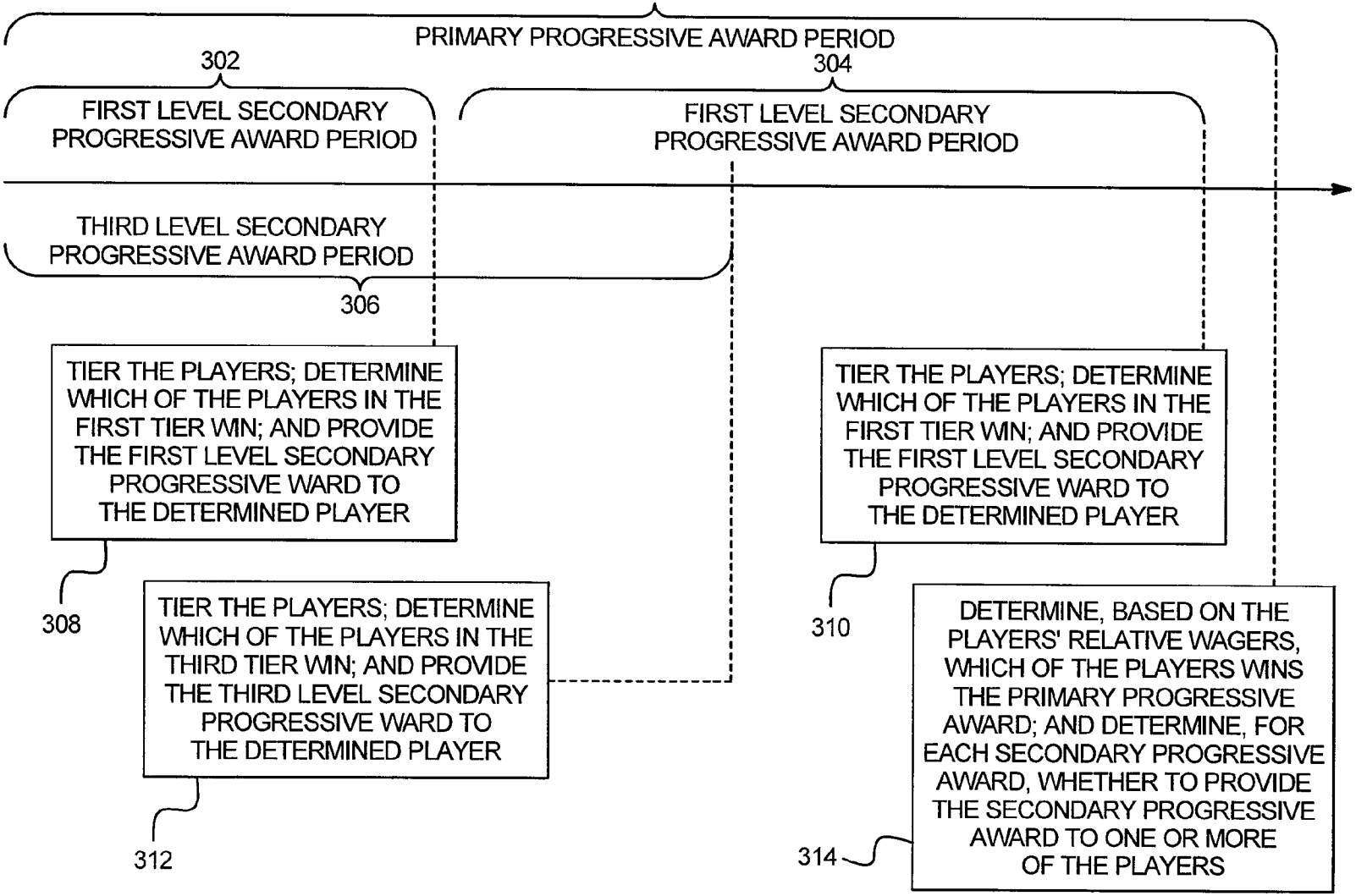
FIG. 12 is one example of a timeline showing the operation of one embodiment of the disclosed gaming system.

Referring now to FIG. 12, a timeline 270 is illustrated showing the operation of the disclosed gaming system in accordance with one embodiment. As described above, the gaming system tracks player wagers and any points accumulated by each player over different plays of one or more games at respective gaming devices in the gaming system. As illustrated in FIG. 12, the timeline 270 illustrates a primary progressive award period 300 in which the gaming system enables one or more players to win a primary progressive award. The timeline 270 also illustrates a plurality of secondary progressive award periods 302, 304 and 306 in which one or more players can win different secondary progressive awards. As illustrated in FIG. 12, the primary progressive award period 300 coincides with a plurality of secondary progressive award periods 302, 304 and 306 so that the gaming system enables one or more players to win one of the secondary progressive awards while also having the opportunity to win the primary progressive award. In one embodiment, the gaming system causes one or more secondary progressive awards to be triggered before the primary progressive award.

As illustrated by the timeline 270, the primary progressive period 300 starts at an initial time and extends until the triggering event for the primary progressive award occurs (e.g., point 314 along timeline 270). If the triggering event for the primary progressive award occurs, the gaming system determines which one of the players will win the primary progressive award based on the player's wager amount or wager history as described above.

In the embodiment illustrated in FIG. 12, a first secondary progressive period 300 is associated with the first level secondary progressive award. The first secondary progressive period starts. During the first secondary progressive period, the gaming system tracks each of the player's wagers (or coin-in) and accumulates a quantity of progressive event points for each player in association with the plays of the games at the gaming devices. When the triggering event occurs for the first level secondary progressive award, the first secondary progressive period 300 ends. At this time 308, the gaming system assigns the players eligible for the first level secondary progressive award to a first one of the progressive event tiers, determines which of the players in that first progressive event tier win the first level progressive award and provide the first level progressive award progressive award to the determined player. In one embodiment, the gaming system resets the first level secondary progressive award and begins a second secondary progressive period 302 that is associated with the reset first level secondary progressive award. When another triggering event occurs for the first level secondary progressive award, the second secondary progressive period 304 ends. At this time 310, the gaming system assigns the players eligible for the first level secondary progressive award to the first progressive event tier, determines which of the players in the first progressive event tier win the first level progressive award and provide the first level progressive award to the determined player.

As illustrated by the timeline 270, in this embodiment, a plurality of secondary progressive periods overlap or run concurrently with one another and with the primary progressive period. In this embodiment, a third secondary progressive period 306 is associated with a third level secondary progressive award. Timeline 270 shows that the first and third secondary progressive periods 302 and 306 overlap and end at different times. When the triggering event occurs for the third level secondary progressive award, the third secondary progressive period 306 ends. At this time 312, the gaming system assigns the players eligible for the third level secondary progressive award to a third one of the progressive event tiers, determines which of the players in the third progressive event tier win the third level progressive award and provide the third level progressive award to the determined player.

In one alternative embodiment, the gaming system assigns at least one player to one of a plurality of progressive event tiers based on one or more parameters. In different embodiments, the gaming system assigns at least one player to one of a plurality of progressive event tiers based on one or more of the following parameters: (i) the quantity of progressive points accumulated by that player, (ii) an amount of coin-in accumulated into one or more pools associated with that player, (iii) an amount of coin-out accumulated into one or more pools associated with that player, (iv) the status of that player (e.g., as determined through a suitable player tracking system), (v) a predetermined variable or game outcome, (vi) a generated symbol or symbol combination, (vii) a random determination by the central controller, (viii) a random determination at the gaming machine, (ix) time (such as the time of day), (x) a wager placed by that player, or (xi) any other suitable method or criteria.

In different embodiments of the gaming system disclosed herein, (i) a progressive event point accumulation event occurs, (ii) a progressive triggering event occurs, (iii) a primary progressive award triggering event occurs, and/or (iv) a secondary progressive award triggering event occurs based on an amount coin-in. In this embodiment, the gaming system determines if an amount of coin-in wagered at one or more gaming devices in the gaming system reaches or exceeds a designated amount of coin-in (i.e., a threshold coin-in amount). Upon the amount of coin-in wagered at one or more gaming devices in the gaming system reaching or exceeding the threshold coin-in amount, the gaming system causes one or more of such progressive events or conditions to occur. In different embodiments, the threshold coin-in amount is predetermined, randomly determined, determined based on a player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day) or determined based on any other suitable method or criteria.

In different embodiments of the gaming system disclosed herein, (i) a progressive event point accumulation event occurs, (ii) a progressive triggering event occurs, (iii) a primary progressive award triggering event occurs, and/or (iv) a secondary progressive award triggering event occurs on an amount coin-out. In this embodiment, the gaming system determines if an amount of coin-out provided by one or more gaming devices in the gaming system reaches or exceeds a designated amount of coin-out (i.e., a threshold coin-out amount). Upon the amount of coin-out provided at one or more gaming devices in the gaming system reaching or exceeding the threshold coin-out amount, the gaming system causes one or more of such events or conditions to occur. In different embodiments, the threshold coin-out amount is predetermined, randomly determined, determined based on a player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day) or determined based on any other suitable method or criteria.

In different embodiments of the gaming system disclosed herein, (i) a progressive event point accumulation event occurs, (ii) a progressive triggering event occurs, (iii) a primary progressive award triggering event occurs, and/or (iv) a secondary progressive award triggering event occurs based on a predefined variable reaching a defined parameter threshold. For example, when the $500{,}000^{th}$ player has played a gaming machine of the gaming system (ascertained from a player tracking system), one or more of such events or conditions occur. In different embodiments, the predefined parameter thresholds include a length of time, a length of time after a certain dollar amount is hit, a wager level threshold for a specific machine (which gaming device is the first to contribute $250,000), a number of gaming machines active, or any other parameter that defines a suitable threshold.

In different embodiments of the gaming system disclosed herein, (i) a progressive event point accumulation event occurs, (ii) a progressive triggering event occurs, (iii) a primary progressive award triggering event occurs, and/or (iv) a secondary progressive award triggering event occurs based on time. In this embodiment, a time is set for when one or more of such events or conditions will occur. In one embodiment, such a set time is based on historic data. For example, the gaming system causes the progressive award triggering event to occur prior to a designated time (e.g., before 2:30 pm on Dec. 30, 2008). In another example, the gaming system causes the progressive award triggering event to occur within a designated period of time (e.g., 30 to 40 days).

In different embodiments of the gaming system disclosed herein, (i) a progressive event point accumulation event occurs, (ii) a progressive triggering event occurs, (iii) a primary progressive award triggering event occurs, and/or (iv) a secondary progressive award triggering event occurs based upon gaming system operator defined player eligibility parameters stored on a player tracking system (such as via a player tracking card or other suitable manner). In this embodiment, the parameters for eligibility are defined by the gaming system operator based on any suitable criterion. In one embodiment, the central controller/gaming device processor recognizes the player's identification (via the player tracking system) when the player inserts or otherwise associates their player tracking card in the gaming machine. The central server/gaming device processor determines the player tracking level of the player and if the current player tracking level defined by the gaming system operator is eligible for one or more of such events or conditions. In one embodiment, the gaming system operator defines minimum bet levels required for such events or conditions to occur based on the player's card level.

In different embodiments of the gaming system disclosed herein, (i) a progressive event point accumulation event occurs, (ii) a progressive triggering event occurs, (iii) a primary progressive award triggering event occurs, and/or (iv) a secondary progressive award triggering event occurs based on a system determination, including one or more random selections by the central controller. In one embodiment, as described above, the central controller tracks all active gaming machines and the wagers they placed. Each gaming machine has its own entry defining its state as either active or inactive and also defining the values of the wagers from that gaming machine. In one embodiment, active status means that the gaming machine is being actively played by a player and enrolled/inactive status means that the gaming machine is not being actively played by a player. The active status requirements can be based on any suitable number of satisfied criteria or defined in any suitable manner by the implementer of the gaming system. In one such embodiment, based on the gaming machine's state as well as one or more wager pools associated with the gaming machine, the central controller determines whether to one or more of such events or conditions will occur. In one such embodiment, the player who consistently places a higher wager is more likely to be associated with an occurrence of one or more of such events or conditions than a player who consistently places a minimum wager. It should be appreciated that the criteria for determining whether a player is in active status or inactive status for determining if one or more of such events occur may the same as, substantially the same as, or different than the criteria for determining whether a player is in active status or inactive status for another one of such events to occur.

In different embodiments of the gaming system disclosed herein, (i) a progressive event point accumulation event occurs, (ii) a progressive triggering event occurs, (iii) a primary progressive award triggering event occurs, and/or (iv) a secondary progressive award triggering event occurs based on a determination of if any numbers allotted to a gaming device match a randomly selected number. In this embodiment, upon or prior to each play of each gaming machine, a gaming device selects a random number from a range of numbers and during each primary game, the gaming machine allocates the first N numbers in the range, where N is the number of credits bet by the player in that primary game. At the end of the primary game, the randomly selected number is compared with the numbers allocated to the player and if a match occurs, one or more of such events or conditions occur. It should be appreciated that any suitable manner of causing one or more bonus event elements to be provided may be implemented in accordance with the gaming system and method disclosed herein.

In one embodiment, the gaming system enables each player to accumulate a quantity of progressive event points in association with an occurrence of a designated symbol or symbol combination in one or more plays of the game. In one such embodiment, a plurality of the gaming devices in the gaming system are associated with one or more different games having different designated symbols or symbol combinations and different probability data associated with those designated symbols or symbol combinations. That is, in one embodiment, the different games have the same designated symbols associated with different probability data. In another embodiment, the different games have different symbols associated with different probability data. For example, the greater the quantity of progressive event points associated with a symbol or symbol combination, the lower the odds or probability of the designated symbol or symbol combination occurring in (or being generated for) the game. That is, the quantity of progressive event points is scaled to the odds of the symbol occurrence. In different embodiments, the gaming system utilizes overlay symbols or modifier symbols to provide progressive event points. In such embodiments, the gaming system incorporates the overlay symbols or modifier symbols in addition to other symbols (e.g., any existing symbols in a game) such that the overlay symbol or the modifier symbol has the same probability across a plurality of different games. In these embodiments, the gaming system enables one, a plurality of, or each player to accumulate a quantity of progressive event points in association with an occurrence of a designated overlay symbol and/or a designated modifier symbol in one or more plays of one or more different games.

As indicated above, in different embodiments, the progressive awards are mystery awards provided to the players of the gaming devices with or without explanation or information provided to the player, or alternatively displayed to the player. In one embodiment, the gaming system provides suitable information about the progressive awards to the players through one or more displays on the gaming machines or additional information displays positioned near the gaming machines, such as above a bank of system gaming machines.

This information can be used to entertain the player or inform the player that a bonus event has occurred or will occur. Examples of such information are:

(1) that a triggering event has occurred;

(2) that a triggering event will shortly occur (i.e., foreshadowing the triggering event);

(3) that one or more progressive awards have been provided to one or more players of the system gaming machines;

(4) that one or more progressive awards will be shortly provided to one or more players of the system gaming machines;

(5) which gaming machines have won awards such as primary awards, secondary awards or progressive awards;

(6) the amount of the progressive awards won;

(7) the amount of the progressive awards that can be won; and (8) the progressive event tier or level that a player is currently assigned.

It should be appreciated that such information can be provided to the players through any suitable audio, audio-visual or visual devices.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system central controller comprising:

at least one processor; and at least one memory device which stores a plurality of instructions, which when executed by the at least one processor, cause the at least one processor to operate with a plurality of gaming devices to:

(a) maintain a plurality of progressive awards, (b) for each of a plurality of players, upon an occurrence of a point accumulation event, accumulate a quantity of progressive event points for that player, and (c) after an occurrence of a triggering event:

(i) determine a designated wager amount placed by each of the players playing at the plurality of gaming devices during a designated period of time, (ii) select one of the players playing at one of the gaming devices during the designated period of time to win one of the progressive awards, the selection based on the designated wager amount placed by the selected player during the designated period of time, (iii) assign the selected player to one of a plurality of progressive event tiers based on the quantity of progressive event points accumulated for the selected player, each one of the progressive awards associated with a probability of being provided for the assigned progressive event tier, (iv) randomly select at least one of the progressive awards in accordance with the probabilities associated with the assigned progressive event tier, and (v) cause the at least one randomly selected progressive award to be provided to the selected player.

2. The gaming system central controller of claim 1, wherein the plurality of progressive awards are arranged as a multi-level progressive award.

3. The gaming system central controller of claim 1, wherein each one of the progressive awards is associated with a probability of being provided for each of the plurality of progressive event tiers.

4. The gaming system central controller of claim 3, wherein each one of the progressive event tiers is associated with a different range of progressive event points, each of the ranges including a minimum progressive event point value and a maximum progressive event point value.

5. The gaming system central controller of claim 1, wherein when executed by the at least one processor, the plurality of instructions cause the at least one processor to determine whether the point accumulation event has occurred in association with a game being played at each of the gaming devices, and if the point accumulation event has occurred in association with the game being played at one of the gaming devices, track the quantity of progressive event points accumulated for the player playing the game at said gaming device.

6. The gaming system central controller of claim 1, wherein when executed by the at least one processor, the plurality of instructions cause the at least one processor to select one of the players playing at one of the gaming devices based on the designated wager amount placed by that player relative to the designated wager amounts placed by the other players at the other gaming devices.

7. The gaming system central controller of claim 1, wherein when executed by the at least one processor, the plurality of instructions cause the at least one processor to select one of the players playing at one of the gaming devices based on the designated wager amount placed by that player during the designated period of time relative to the designated wager amounts placed by the other players at the other gaming devices during the designated period of time.

8. A gaming system central controller comprising:

at least one processor; and at least one memory device which stores a plurality of instructions, which when executed by the at least one processor, cause the at least one processor to operate with a plurality of gaming devices to:

(a) maintain a primary progressive award and a plurality of secondary progressive awards, (b) for each of a plurality of players, upon an occurrence of a point accumulation event, accumulate a quantity of progressive event points for that player, (c) cause an occurrence of a primary triggering event during a designated period of time, the primary triggering event being associated with the primary progressive award, (d) after the occurrence of the primary triggering event:

(i) determine a designated wager amount placed by each one of the players prior to the occurrence of the primary triggering event, (ii) select one of the players to be provided the primary progressive award, the selection based on the designated wager amount placed by the selected player prior to the occurrence of the primary triggering event, (iii) cause the primary progressive award to be provided to the selected player, (iv) assign each one of the players to one of a plurality of progressive event tiers based on the accumulated quantity of progressive event points for that player, each one of the progressive event tiers being associated with a different one of the plurality of secondary progressive awards, and (v) for each progressive event tier assigned at least one player:

(A) determine which of the players assigned to the progressive event tier will be provided the associated secondary progressive based on the designated wager amount each assigned player placed prior to the occurrence of the primary triggering event, and (B) cause the associated secondary progressive award to be provided to the determined player, and (e) after an occurrence of a secondary triggering event, the secondary triggering event being associated with a designated one of the secondary progressive awards:

(i) assign each of the players to one of a plurality of progressive event tiers based on the accumulated quantity of progressive event points associated with each player, a designated progressive event tier being associated with the designated one of the secondary progressive awards, and (ii) for the designated progressive event tier:

(A) determine which of the players assigned to the designated progressive event tier will be provided the designated one of the secondary progressive awards based on the designated wager amount each assigned player placed prior to the occurrence of the secondary triggering event, and (B) cause the designated one of the secondary progressive awards to be provided to the determined player.

9. The gaming system central controller of claim 8, wherein the plurality of secondary progressive awards are arranged as a multi-level progressive award.

10. The gaming system central controller of claim 9, wherein each one of the progressive event tiers is associated with a different level of the multi-level progressive award.

11. The gaming system central controller of claim 8, wherein when executed by the at least one processor, the plurality of instructions cause the at least one processor to select one of the players playing at one of the gaming devices based on the designated wager amount placed by that player relative to the designated wager amounts placed by the other players at the other gaming devices.

12. The gaming system central controller of claim 8, wherein when executed by the at least one processor, the plurality of instructions cause the at least one processor to select one of the players playing at one of the gaming devices during the designated period of time based on the designated wager amount placed by that player prior to the occurrence of the primary triggering event relative to the designated wager amounts placed by the other players at the other gaming devices prior to the occurrence of the primary triggering event.

13. A gaming system central controller comprising:

at least one processor; and at least one memory device which stores a plurality of instructions, which when executed by the at least one processor, cause the at least one processor to operate with a plurality of gaming devices to:

(a) maintain a plurality of progressive awards, (b) for each of a plurality of players, upon an occurrence of a point accumulation event, accumulate a quantity of progressive event points for that player, and (c) after an occurrence of a triggering event:

(i) select one of the players based on a designated wager amount placed prior to the triggering event, (ii) assign the selected player to one of the plurality of progressive event tiers based on the quantity of progressive event points accumulated for the selected player, (iii) for each one of a plurality of the progressive awards, determine whether to provide said progressive award in accordance with a probability associated with the assigned progressive event tier, and (iv) if the determination is to provide at least one of the progressive awards, cause said at least one of the progressive awards to be provided to the selected player.

14. The gaming system central controller of claim 13, wherein the plurality of progressive awards are arranged as a multi-level progressive award.

15. The gaming system central controller of claim 13, wherein each one of the progressive event tiers is associated with a different range of progressive event points, each of the ranges including a minimum progressive event point value and a maximum progressive event point value.

16. The gaming system central controller of claim 13, wherein when executed by the at least one processor, the plurality of instructions cause the at least one processor to determine, for each one of the maintained progressive awards, whether to provide said progressive award in accordance with a probability associated with the assigned progressive event tier.

17. The gaming system central controller of claim 13, wherein when executed by the at least one processor, the plurality of instructions cause the at least one processor to select one of the players based on the designated wager amount placed by the selected player prior to the triggering event relative to the designated wager amount placed by each of the other players at the other gaming devices prior to the triggering event.

18. A gaming system comprising:

a plurality of gaming devices, and at least one central controller configured to operate with the plurality of the gaming devices to:

(a) maintain a plurality of progressive awards, (b) for each of a plurality of players, if a designated symbol combination is generated in association with a play of a game, accumulate a quantity of progressive event points for that player, and (c) after an occurrence of a triggering event:

(i) select one of the players to win one of the progressive awards, the selection being based on a designated wager placed by the selected player, (ii) assign the selected player to one of a plurality of progressive event tiers based on the quantity of progressive event points accumulated for the selected player, each one of the progressive awards associated with a probability of being provided for the assigned progressive event tier, (iii) randomly select at least one of the progressive awards in accordance with the probabilities associated with the assigned progressive event tier, and (iv) cause the at least one randomly selected progressive award to be provided to the selected player.

19. The gaming system of claim 18, wherein, for at least one of the players, the quantity of progressive event points accumulated for that player is based on a quantity of the designated symbol combinations generated in association with the play of the game for that player.

20. The gaming system of claim 18, wherein, for at least one of the players, the quantity of progressive event points accumulated for that player is based on the designated symbol combination generated in association with the play of the game for that player.

21. A gaming system comprising:

a plurality of gaming devices, and at least one central controller configured to communicate with the plurality of the gaming devices and programmed to operate with said gaming devices to:

(a) maintain a primary progressive award and a plurality of secondary progressive awards, (b) for each of a plurality of players, if a designated symbol combination is generated in association with a play of a game, accumulate a quantity of progressive event points for that player, (c) cause an occurrence of a primary triggering event within a designated period of time, the primary triggering event being associated with the primary progressive award, (d) after the occurrence of the primary triggering event:

(i) select one of the players to be provided the primary progressive award, the selection based on a designated wager placed by the selected player, (ii) cause the primary progressive award to be provided to the selected player, (iii) assign each one of the players to one of a plurality of progressive event tiers based on the accumulated quantity of progressive event points for that player, each one of the progressive event tiers being associated with a different one of the plurality of secondary progressive awards, and (iv) for each progressive event tier assigned at least one player:

(A) determine which of the players assigned to the progressive event tier will be provided the associated secondary progressive based on the designated wager amount each assigned player placed, and (B) cause the associated secondary progressive award to be provided to the determined player, and (e) after an occurrence of a secondary triggering event, the secondary triggering event being associated with a designated one of the secondary progressive awards:

(i) assign each of the players to one of a plurality of progressive event tiers based on the accumulated quantity of progressive event points associated with each player, a designated progressive event tier being associated with the designated one of the secondary progressive awards, and (ii) for the designated progressive event tier:

(A) determine which of the players assigned to the designated progressive event tier will be provided the designated one of the secondary progressive awards based on the designated wager amount each assigned player placed, and (B) cause the designated one of the secondary progressive awards to be provided to the determined player.

22. The gaming system of claim 21, wherein, for at least one of the players, the quantity of progressive event points accumulated for that player is based on a quantity of the designated symbol combinations generated in association with the play of the game for that player.

23. The gaming system of claim 21, wherein, for at least one of the players, the quantity of progressive event points accumulated for that player is based on the designated symbol combination generated in association with the play of the game for that player.

* * * * *

UNITED STATES PATENT AND TRADEMARK OFFICE

CERTIFICATE OF CORRECTION

PATENT NO. : 8,092,302 B2
APPLICATION NO. : 12/269456
DATED : January 10, 2012
INVENTOR(S) : Ryan W. Cuddy et al.

It is certified that error appears in the above-identified patent and that said Letters Patent is hereby corrected as shown below:

IN THE CLAIMS:

In Claim 8, column 40, line 41, after “progressive” add --award--.

In Claim 8, column 40, line 49, replace “a” with --the--.

In Claim 13, column 41, line 35, before “plurality” replace “the” with --a--.

In Claim 16, column 41, line 61, replace “a” with --the--.

In Claim 21, column 43, line 3, after “progressive” add --award--.

In Claim 21, column 43, line 3, replace “the” with --a--.

In Claim 21, column 43, line 10, replace “a” with --the--.

Signed and Sealed this
Tenth Day of July, 2012

David J. Kappos

David J. Kappos
*Director of the United States Patent and Trademark Office*